US006791245B2

(12) United States Patent
Nasu et al.

(10) Patent No.: US 6,791,245 B2
(45) **Date of Patent: *Sep. 14, 2004**

(54) GLOW PLUG AND SPARK PLUG, AND MANUFACTURING METHOD THEREFOR

(75) Inventors: Hiroaki Nasu, Nagoya (JP); Wataru Matsutani, Nagoya (JP); Chiaki Kumada, Gifu (JP); Katsunari Ninomiya, Tokai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 34 days.

This patent is subject to a terminal disclaimer.

(21) Appl. No.: 10/176,004

(22) Filed: Jun. 21, 2002

(65) Prior Publication Data

US 2002/0163286 A1 Nov. 7, 2002

Related U.S. Application Data

(62) Division of application No. 09/790,655, filed on Feb. 23, 2001, now Pat. No. 6,437,493, which is a division of application No. 09/514,200, filed on Feb. 25, 2000, now Pat. No. 6,236,148.

(30) Foreign Application Priority Data

Feb. 25, 1999 (JP) ..... 11/49018
Feb. 25, 1999 (JP) ..... 11/49019

(51) Int. Cl.[7] ..... H01T 13/20; H01T 13/39
(52) U.S. Cl. ..... 313/141; 313/118; 445/7
(58) Field of Search ..... 313/118, 141; 445/7

(56) References Cited

U.S. PATENT DOCUMENTS 3,851,637 A 12/1974 Green
4,705,575 A 11/1987 Koch
4,967,116 A 10/1990 Oshima
6,236,148 B1 * 5/2001 Nasu et al. ..... 313/141
6,437,493 B2 * 8/2002 Nasu et al. ..... 313/141
6,538,365 B2 * 3/2003 Nasu et al. ..... 313/118
2002/0193033 A1 * 12/2002 Nasu et al. ..... 455/7

FOREIGN PATENT DOCUMENTS

| | | |
|---|---|---|
| DE | 196 15 664 A1 | 10/1997 |
| DE | 196 38 176 A1 | 4/1998 |
| GB | 2 078 261 A | 1/1982 |
| JP | 1-92092 | 6/1989 |
| JP | 56-15791 | 4/1991 |
| JP | 6-84547 | 10/1994 |
| JP | 06-316789 | 11/1994 |
| JP | 8-337897 | 12/1996 |
| JP | 10-350229 | 12/1998 |
| JP | 2000-234177 | 8/2000 |
| JP | 2003-71232 | 9/2003 |

OTHER PUBLICATIONS

Patent Abstract of Japan; Publication No. 01015397; Jan. 19, 1989; Suganuma Nobuyuki.

Patent Abstract of Japan, Publication No. 01015396, Jan. 19, 1989.

Chromitierung (ein neues, ungifiges Verfahren zur Zinkpassivierung, Peter Hulser, et al., Carl Hanser Verlag, Munchen, 1996.

* cited by examiner

*Primary Examiner*—Vip Patel
*Assistant Examiner*—Mariceli Santiago
(74) *Attorney, Agent, or Firm*—Sughrue Mion, PLLC

(57) ABSTRACT

In a glow plug and a spark plug, the surface of a main metal shell is coated with a chromate film in which the quantity of trivalent chrome is 95 wt % or more of the contained chrome components and which has a thickness of 0.2 $\mu$m to 0.5 $\mu$m.

5 Claims, 20 Drawing Sheets

CORROSION RESISTANCE IN ACID ATMOSPHERE

CORROSION RESISTANCE IN NEUTRAL SALT SPRAY TEST AFTER HEAT RESISTANCE
(TIME AT WHICH WHITE-RUST AREA WAS ENLARGED TO 20%)

TIME FOR WHICH IMMERSION IN CHROMATE BATH WAS PERFORMED : 60 SECONDS

CORROSION RESISTANCE IN ACID ATMOSPHERE

CORROSION RESISTANCE IN NEUTRAL SALT SPRAY TEST AFTER HEAT RESISTANCE
(TIME AT WHICH WHITE-RUST AREA WAS ENLARGED TO 20%)

GLOW PLUG AND SPARK PLUG, AND MANUFACTURING METHOD THEREFOR

This is a divisional of application Ser. No. 09/790,655, filed Feb. 23, 2001, now U.S. Pat. No. 6,437,493, which is a divisional of Ser. No. 09/514,200, filed Feb. 25, 2000, now U.S. Pat. No. 6,236,148 the disclosure of which is incorporated herein by reference.

BACKGROUND OF THE INVENTION

1. Field of the Invention

The present invention relates to a glow plug for previously heating a diesel engine or the like, a spark plug for an internal combustion engine, and a manufacturing method therefor.

2. Description of the Related Art

In general, a glow plug has a structure that a resistance heater is disposed in a main metal shell having the outer surface on which a joining thread portion has been formed such that a leading end heating portion of the resistance heater projects over either end surface of the main metal shell. The thread portion is used to join the glow plug to an engine head.

A spark plug for igniting a gasoline engine for an automobile or the like incorporates an insulating member disposed on the outside of a central electrode and a main metal shell disposed on the outside of the insulating member. Moreover, a ground electrode for forming a spark discharge gap from the central electrode is joined to the main metal shell. A joining thread portion provided for the outer surface of the main metal shell is used to joint the spark plug to the cylinder head of the engine.

The main metal shell is usually made of an iron material, such as carbon steel, and structured to have the surface applied with zinc plating to prevent corrosion. Although the zinc-plated layer has an excellent anti-corrosion effect for iron, the zinc-plated layer formed on iron can easily be consumed owing to sacrificial corrosion as known. What is worse, the zinc-plated layer is decolored to white owing to zinc oxide, causing the quality of the appearance to deteriorate. Therefore, a major portion of the glow plugs and the spark plug is structured such that the surface of the zinc-plated layer is coated with a chromate film to prevent corrosion of the plated layer.

The chromate film to be formed on the main metal shell of the glow plug and the spark plug has been a so-called yellow chromate film. Since the yellow chromate film exhibits excellent anti-corrosion performance, the yellow chromate film is widely employed in a variety of fields including coating of the inner surface of a can as well as the glow plug and the spark plug. Since a portion of contained chrome components is hexavalent chrome, use of the yellow chromate film has gradually been inhibited in recent years owing to global focusing on the environmental protection. For example, discontinuance of the chromate film containing hexavalent chrome in the future has been considered in, for example, the automobile industrial field in which glow plugs and spark plugs are used in a large quantity. Since a processing bath for forming the yellow chromate film contains hexavalent chrome at a relatively high concentration, there arises a problem in that an excessively large cost is required to dispose waste water.

Therefore, chromate films of a type which does not contain hexavalent chrome, that is, films of a type that the substantially overall portion of chrome components is contained as trivalent chrome have been researched and developed at a relatively earlier time. Thus, processing baths containing hexavalent chrome at a relatively low concentration or baths containing no hexavalent chrome have been developed. Therefore, the problem of disposal of waste waster has been overcome. However, the chromate film employing the trivalent chrome suffers from unsatisfactory anti-corrosion performance as compared with the yellow chromate film. Therefore, wide use of the yellow chromate film as a film with which the main metal shell of the glow plug and the spark plug is coated has not been realized.

Further, the conventional chromate films including the yellow chromate films suffer from a common problem of unsatisfactory heat resistance. Since, for example, the engine of an automobile incorporates a cylinder head to which the spark plug is joined is cooled with water, the temperature of the spark plug is not raised excessively. When the operation of the engine is continued under a condition that a great load of heat is exerted or when the spark plug is joined relatively adjacent to the exhaust manifold, the temperature of the main metal shell is sometimes raised to about 200° C. to 300° C. In the foregoing case, the chromate film easily deteriorates. Thus, there arises a problem in that the anti-corrosion performance rapidly deteriorates. Moreover, the conventional chromate film suffers from deterioration in the performance owing to attack of an acid component, such as carbon dioxide, a nitrogen oxide or a sulfur oxide, contained in acid rain and exhaust gas and, in a case of a gas engine, acid water produced by the engine.

SUMMARY OF THE INVENTION

It is an object of the present invention is to provide a glow plug and a spark plug having a chromate film which covers the surface of its main metal shell and which contains hexavalent chrome in a small quantity and exhibiting excellent anti-corrosion performance and heat resistance as compared with those of a conventional chromate film and a manufacturing method therefor.

To solve the foregoing problems, according to one aspect of the present invention, there is provided a glow plug comprising: a resistance heater disposed in a main metal shell such that the leading end of the resistance heater projects over either end surface of the main metal shell, wherein the surface of the main metal shell is coated with a chromate film containing trivalent chrome by 95 wt % or more of contained chrome components and having a thickness of 0.2 μm to 0.5 μm.

Further, according to another aspect of the present invention, there is provided a spark plug comprising: a central electrode; an insulating member disposed on the outside of the central electrode; a main metal shell disposed on the outside of the insulating member; and a ground electrode disposed opposite to the central electrode such that a spark discharge gap is formed, wherein the surface of the main metal shell is coated with a chromate film containing trivalent chrome by 95 wt % or more of contained chrome components and having a thickness of 0.2 μm to 0.5 μm.

The foregoing structure are arranged such that the surface of the main metal shell is coated with a chromate film containing trivalent chrome by 95 wt % or more of contained chrome components and having a thickness of 0.2 μm to 0.5 μm. That is, a usual yellow chromate film contains hexavalent chrome by about 25 wt % to 35 wt % of the chromate components. On the other hand, the film according to the present invention contains hexavalent chrome in a small quantity of 5 wt % or less of the chrome components.

Therefore, and effect required of the environmental protection can be improved. The employed chromate processing solution does not contain any hexavalent chrome or contains the same in a small quantity as compared with a processing solution for forming the yellow chromate film. Hence it follows that a problem of disposal of waste water does not easily occur.

The inventors of the present invention has considered that, for example, a glossy chromate film, called a unichrome film, and a conventional trivalent chrome film, such as a blue chromate film, having a small thickness of 0.1 μm cannot realize satisfactory anti-corrosion characteristic and heat resistance with respect to the main metal shell in a major environment for the glow plug and the spark plug for use. Therefore, investigations of the thickness have been performed energetically. As a result, a preferred thickness range for the glow plug and the spark plug has been detected and, therefore the present invention has been achieved. That is, when the thickness of the chromate film is made to be 0.2 μm or greater, the anti-corrosion performance of the chromate film mainly composed of trivalent chrome can considerably be improved. Therefore, the durability against corrosion of the main metal shell can sufficiently be improved. In an environment peculiar for the glow plug and the spark plug in which the temperature can easily be raised and attack of acids caused from exhaust gas components ($CO_2$ and $NO_X$) cannot be prevented, the anti-corrosion performance of the main metal shell can satisfactorily be maintained.

A main portion of the glow plugs has a structure that an energizing terminal shaft for energizing the resistance heater is disposed such that the rear end of the energizing terminal shaft projects over another end surface of the main metal shell. Moreover, a nut for securing a power supply cable to the energizing terminal shaft is engaged to a male thread portion formed in the rear end portion of the energizing terminal shaft. In the foregoing case, at least a portion of the surface of the nut is coated with the chromate film. Therefore, satisfactory anti-corrosion performance and heat resistance can be imparted to the nut as well as the main metal shell.

A portion of spark plugs incorporates an annular gasket which must be fitted to the base of a joining thread portion provided for the outer surface of the main metal shell. When the thread portion of the main metal shell is screwed in a thread hole of the cylinder head, the gasket is compressed and deformed as if it is crushed between a flange-shape gas sealing portion provided for the base of the thread portion and the periphery of the opening of the thread hole to seal a space between the thread hole and the gas sealing portion. In the foregoing case, at least a portion of the surface of the gasket can be coated with the foregoing chromate film. Therefore, satisfactory anti-corrosion performance and heat resistance can be imparted to the gasket as well as the main metal shell.

When the thickness of the chromate film is smaller than 0.2 μm, satisfactory anti-corrosion performance and heat resistance cannot be realized. When the thickness is larger than 0.5 μm, a crack of the film occurs and/or separation of the film easily takes place. Thus, the anti-corrosion performance undesirably deteriorates. It is preferable that the thickness of the chromate film is 0.3 μm to 0.5 μm. It is preferable that the chromate film does not substantially contain hexavalent chrome.

The chromate process is one of conversion treatment processes with which substitution and deposition of the chrome components are performed while base metal is being oxidized and eluted. Therefore, an electroless chromate process in which no electric power is supplied from outside must use metal which can be eluted into the chromate processing bath as the base metal. In general, the main metal shell, the nut or the gasket of the glow plug and/or spark plug is constituted by an iron material, such as carbon steel. Thus, a zinc type plated layer, the main metal component of which is zinc, may be formed on the surface of the main metal shell, the nut or the gasket to prevent corrosion. The zinc-plated layer serves as a preferred base metal for forming the chromate film. In the foregoing case, the eluted zinc components are usually taken in the chromate film. Note that the zinc-plated layer can be formed by performing known electrolytic zinc plating or molten zinc plating. When electrolytic chromate processing method is employed, the chromate film can be formed even in a case of a nickel-plated layer, the main metal component of which is nickel.

When the base metal layer is the zinc-plated layer and the chromate film satisfying the above-mentioned thickness range is formed on the base metal layer, time for which white rust appears by about 20% or more of the overall surface caused from corrosion of the zinc-plated film can be made to be 40 hours or longer after chapter five "neutral salt water spray test" of anti-corrosion test of plating conforming to JIS H8502 has been performed. The foregoing anti-corrosion performance level required of the main metal shell of the glow plug and the spark plug is a satisfactory level.

When the base metal layer is constituted by the zinc-plated layer and the chromate film having the above-mentioned thickness is formed, satisfactory durability can be realized even in the following test on the assumption of an environment of use in which the temperature of the glow plug and the spark plug is raised. That is, when heating at 200° C. in the atmosphere for 30 minutes is performed and chapter five "neutral salt water spray test" of anti-corrosion test of plating conforming to JIS H8502 is performed, time for which white rust appears by about 20% or more of the overall surface caused from corrosion of the zinc-plated film can be made to be 40 hours or longer.

Also in the following test on the assumption that the environment of use in which the glow plug and the spark plug is attacked with acids, satisfactory durability can be realized. That is, time for which white rust appears by about 20% or more of the overall surface caused from corrosion of the zinc-plated film can be made to be 20 hours or longer after chapter seven "CASS test" of anti-corrosion test of plating conforming to JIS H8502 has been performed.

In a method of manufacturing a glow plug and a spark plug according to the present invention, the main metal shell (or the nut, or gasket) is immersed in a chromate processing bath containing trivalent chrome salt and a complexing agent for the trivalent chrome mixed therein so that the foregoing chromate film is formed on the main metal shell (or the nut, or gasket).

The chromate processing bath contains the trivalent chrome salt and the complexing agent for the trivalent chrome. Therefore, a close and thick trivalent-chrome type chromate film, which cannot be formed by a usual chromate processing method, can be formed. Thus, the trivalent-chrome type chromate film having a thickness of 0.2 μm to 0.5 μm which is the essential portion of the glow plug and the spark plug according to the present invention can easily be formed. A method of the above-mentioned chromate film has been disclosed in Germany Patent Laid-Open No. DE19638176A1. Then, the method will now be described.

As described above, there is an established theory that the chromate film is formed such that the base metal (for example, zinc) is first oxidized and eluted in the processing bath. The eluted base metal member components and solution containing chromate ions react with one another so that trivalent chrome forms polymer-like complexes owing to hydroxyl groups or oxygen bridges so that the complexes in the form of gels are precipitated and deposited on the surface of the base metal member. In the foregoing case, the chromate film can be grown only when elution of the base metal member and reactions and deposition of the chromate ions contained in the bath take place simultaneously. When the chromate film has been deposited to have a somewhat large thickness, the elution reaction of the base metal member, which is disproportionation through the interface from the solution, is inhibited. Hence it follows that the growth of the film is inhibited.

According to the above-mentioned laid-open Germany patent, it is important for enlarging the thickness of the formed film to minimize the rate at which the deposited chromate film is inversely dissolved while the rate at which the base metal member is dissolved and that at which the film is deposited owing to the reactions between the dissolved base metal member components and trivalent chrome are being raised. It can be considered that the foregoing method enables the thickness of the film to be enlarged because the deposition of the film can be enhanced by adding an appropriate complexing agent into the bath to complex the trivalent chrome.

An effective complexing agent is any one of a variety of chelating agents (dicarboxylic acid, tricarboxylic acid, oxyacid hydroxyl-group dicarboxylic acid or hydroxyl-group tricarboxylic acid: for example, oxalic acid, malonic acid, succinic acid, glutaric acid, adipic acid, pimelic acid, cork acid, selenious acid, sebacic acid, meleic acid, phthalic acid, terephthalic acid, tartaric acid, citric acid, malic acid or ascorbic acid. Another complexing agent may be employed. Complexing agents which can be employed are as disclosed in the foregoing laid-open German Patent.

To enlarge the thickness of the film, it is also effective to raise the temperature of the chromate processing bath to about 20° C. to about 80° C. When the temperature of the bath is lower than 20° C., the effect of enlarging the thickness of the film owing to raising of the temperature cannot substantially be obtained. When the temperature is 80° C. or higher, vaporization of water from the bath takes place excessively. Thus, the conditions of the bath cannot easily be controlled. It is preferable that duration of immersion of the member which must be processed in the chromate bath (the main metal shell and the nut) is 20 seconds to 80 seconds. When the immersion is performed for 20 seconds or shorter, a required thickness of the chromate film cannot sometimes be realized. When the duration of immersion is longer than 80 seconds, the formed chromate film is excessively thickened. Thus, a crack of the film occurs (when, for example, a joining process is performed) or separation of the film easily occurs. Therefore, the anti-corrosion performance sometimes undesirably deteriorates.

To enhance dissolution of the base metal member, it is effective to lower the pH of the chromate processing solution in a range in which re-dissolution of the film formed owing to deposition takes place excessively. A preferred range of the pH is, for example, about 1.5 to about 3. To prevent re-dissolution of the film formed owing to deposition, it is effective that the film contains a hydroxide, such as nickel, cobalt or copper, which cannot easily be re-dissolved. To achieve this, a compound of the foregoing metal may be dissolved and mixed in the chromate processing bath.

Results of repeated investigations performed by the inventors will now be described. When sodium salt (for example, sodium nitrate) in a predetermined quantity is mixed in the chromate processing bath in such a manner that the content of sodium component in the chromate film is 2 wt % to 7 wt %, a close chromate film having a large thickness can be formed. Although the detailed mechanism cannot be detected, it can be considered that containing of sodium ions in the chromate film prevents re-dissolution of the chromate film in the processing bath. When the content of the sodium component in the chromate film does not satisfy the range from 2 wt % to 7 wt %, the thickness of the chromate film cannot sometimes easily be made to be 0.2 $\mu$m or larger. It is preferable that the content of the sodium components in the chromate film is 2 wt % to 6 wt %.

When a film is provided for the nut or the gasket, the foregoing process may be performed by substituting the nut or the gasket for the main metal shell. Thus, the same method may, of course, be employed.

PREFERRED EMBODIMENTS OF THE INVENTION

Embodiments of the present invention will now be described with reference to the drawings.

Figure 1A:
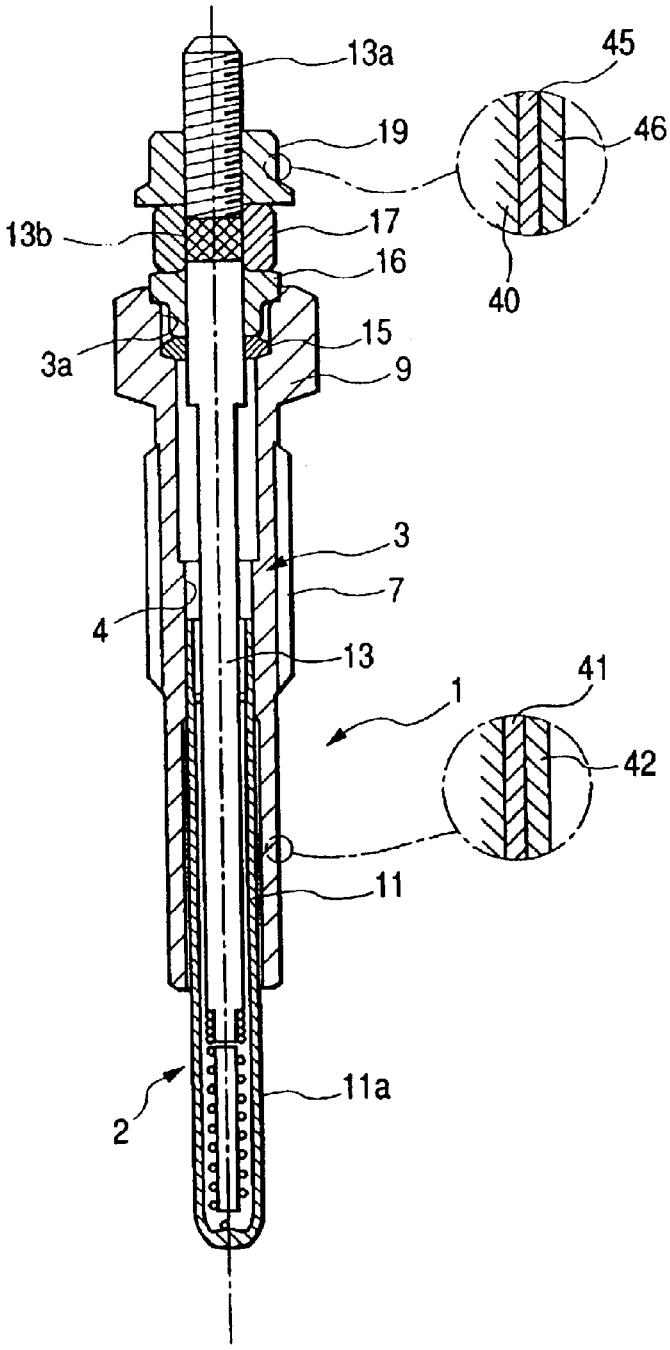
FIG. 1A is a cross sectional view showing a glow plug according to an embodiment of the present invention.
Figure 1B:
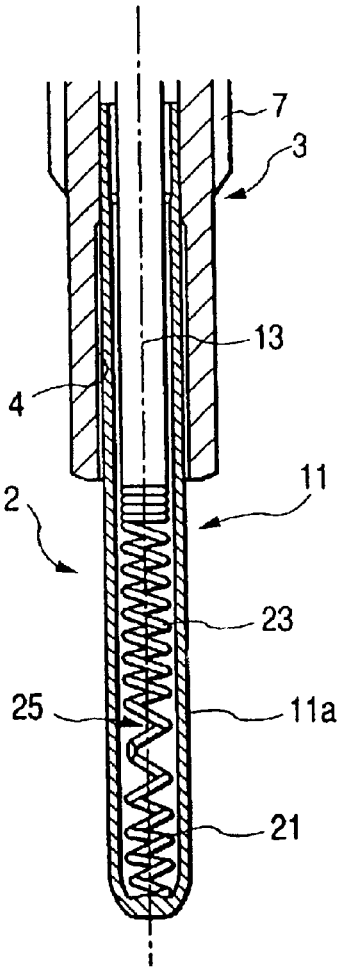
FIG. 1B is a partial enlarged view of FIG. 1A.

A glow plug 1 shown in FIG. 1A and according to an embodiment of the present invention incorporates a sheath heater 2 and a main metal shell 3 disposed on the outside of the sheath heater 2. The sheath heater 2, as shown in FIG. 1B, incorporates a sheath tube 11 having a closed leading end which accommodates two resistor line coils, that is, a heating coil 21 disposed adjacent to the leading end and a control coil 23, in series, connected to the rear end of the heating coil 21 by welding or the like. Moreover, also an insulating material, such as magnesia powder, is accommodated. A body 11*a* of the sheath tube 11 accommodating the heating coil 21 and the control coil 23 has a leading end projecting over the main metal shell 3 to form a projection. The heating coil 21 is connected to the sheath tube 11 at the leading end of the heating coil 21. The outer surface of each of the heating coil 21 and the control coil 23 and the inner surface of the sheath tube 11 is insulated from each other owing to presence of magnesia powder. The main metal shell 3 is formed into a cylindrical shape having a through hole 4 formed in the axial direction of the main metal shell 3. The sheath heater 2 is inserted and secured to the inside portion of the through hole 4 in a state that the leading end of the sheath tube 11 projects by a predetermined length. A tool engaging portion 9 having a hexagonal cross sectional shape is provided for the outer surface of the main metal shell 3 to engage a tool, such as a torque wrench, to the tool engaging portion 9 when the glow plug 1 is joined to a diesel engine.

The base portion of the sheath tube 11 is press-fit into the through hole 4 of the main metal shell 3 so as to be secured to the inside portion of the through hole 4. A countersunk portion 3*a* is provided for the opposite opening of the through hole 4 to receive a rubber O-ring 15 fitted to the outer surface of the energizing terminal shaft 13 and an insulating bush (made of, for example, nylon) 16. A holding ring 17 for preventing separation of the insulating bush 16 is joined to the energizing terminal shaft 13 at the rear of the O-ring 15 and the insulating bush 16. The holding ring 17 is secured to the energizing terminal shaft 13. The surface of the energizing terminal shaft 13 corresponding to the holding ring 17 is provided with a knurling portion 13*b* for enlarging crimping force. A female thread portion 13*a* is provided for the rear end portion of the energizing terminal shaft 13 to engage a nut 19 for securing an energizing cable to the energizing terminal shaft 13.

The glow plug 1 is joined to the cylinder block of a diesel engine by using the thread portion 7 of the main metal shell 3. Thus, the leading end portion of the sheath tube 11 accommodating the heating coil 21 and the control coil 23 is disposed in a combustion chamber (or a sub-combustion chamber) of the engine. When voltage is, in the foregoing state, applied to the energizing terminal shaft 13 from a battery serving as a power source mounted on the vehicle, electric power is supplied through a route, that is, the energizing terminal shaft 13→the control coil 23→the heating coil 21→the sheath tube 11→the main metal shell 3 (grounded through the engine block). As a result of supply of electric power, the sheath heater 2 generates heat owing to the resistor thereof so that fuel injected into the engine block is ignited. Since the temperature of the control coil 23 is low and the electric resistance is low in an early stage of the energization, a relatively high electric current passes to the heating coil 21. Thus, the temperature of the heating coil 21 is rapidly raised. After the temperature of the heating coil 21 has been raised, generated heat causes the control coil 23 to be heated. Thus, the electric resistance is raised, causing the electric current to be supplied to the heating coil 21 to be lowered. Hence it follows that the temperature rise characteristic of the heater is made such that the temperature is rapidly raised in the early stage of the energizing state and the operation of the control coil prevents supply of the electric current. Thus, the temperature is saturated.

The overall outer surface of a base layer (made of, for example, carbon steel) 40 of the main metal shell 3 is coated with a zinc-plated layer 41 (a zinc-plated layer) for preventing corrosion. Moreover, the outer surface of the zinc-plated layer 41 is coated with a chromate film 42. Also the outer surface of the nut 19 is coated with a zinc-plated layer 45 and a chromate film 46. The zinc-plated layers and the chromate films are formed by the same method. Therefore, the portion of the main metal shell 3 will representatively be described.

The zinc-plated layer 41 is formed by a known electrolytic zinc plating method to have a thickness of about 3 $\mu$m to about 20 $\mu$m. When the thickness is smaller than 3 $\mu$m, a satisfactory anti-corrosion characteristic cannot sometimes be maintained. When the thickness is larger than 20 $\mu$m, the thickness is too large from a viewpoint of improving the anti-corrosion characteristic. Thus, the peace time during the manufacturing process is elongated to sometimes raise the cost. Specifically, it is preferable that the thickness of the zinc-plated layer 41 of the main metal shell 3 is 12 $\mu$m to 20 $\mu$m. It is preferable that the thickness of the zinc-plated layer 45 of the nut 19 is 3 $\mu$m to 8 $\mu$m.

The chromate film 42 contains chrome components in which the ratio of trivalent chrome is 95 wt % or more, the chromate film 42 having a thickness of 0.2 $\mu$m to 0.5 $\mu$m. It is preferable that the chrome components contain trivalent chrome in a maximum quantity. It is furthermore preferable that the overall chrome components is the trivalent chrome component.

Figure 2A:
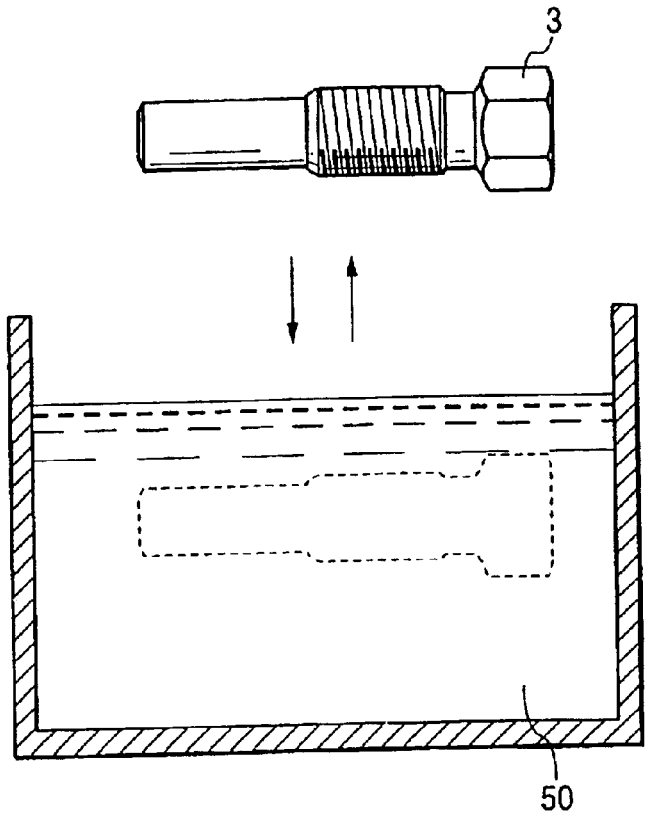
FIG. 2A is a diagram showing a chromate process of a glow plug.

FIG. 2A schematically shows a method of forming the chromate film 42. That is, the main metal shell 3 incorporating the zinc-plated layer caused to have a predetermined thickness by the known electrolytic zinc plating method or the like is immersed in a chromate processing bath 50. The structure of the chromate processing bath 50 has been described. Thus, as shown in FIG. 1A, the chromate film 42 is formed on the surface of the zinc-plated layer 41 of the main metal shell 3. FIG. 2A is a schematic view showing the foregoing process. Although the drawing shows a process that the main metal shell 3 is simply immersed in the chromate processing bath 50. In actual, the known barrel method (a process with which the main metal shells in an unpackaged state are introduced into a liquid permeable container and the process is performed in the processing bath 50 while the container is being rotated) or the like may be employed.

The main metal shell 3 subjected to the chromate process is cleaned with water and dried, and then the main metal shell 3 is introduced into the glow plug 1 shown in FIG. 1A so as to be joined to a diesel engine. The main metal shell 3 or the nut 19 has the chromate film formed on the zinc-plated layer formed and arranged to have the anti-corrosion performance and the heat resistance far superior to those of the conventional trivalent chrome type chromate film or the yellow chromate film. Thus, satisfactory durability against corrosion can be imparted to the zinc-plated layer. The present invention may be applied to the main metal shell or the nut of a glow plug incorporating a ceramic heater employed as a substitute for the sheath heater.

Next, an embodiment concerning to the spark plug will be described as follows.

Figure 1C:
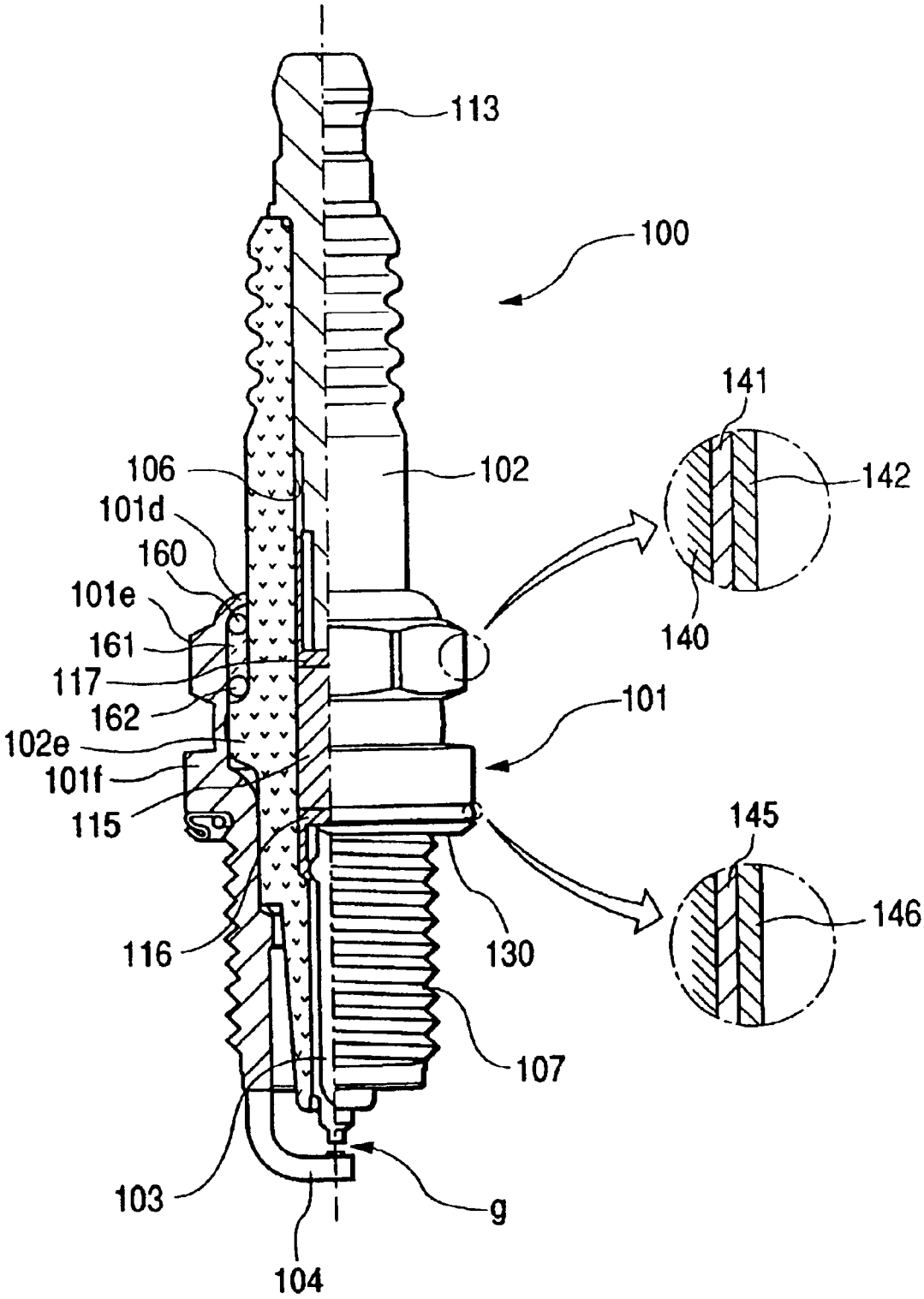
FIG. 1C is a cross section view showing a spark plug according to an embodiment of the present invention.

A spark plug 100 having a resistor according to the embodiment of the present invention and shown in FIG. 1C incorporates a cylindrical main metal shell 101, an insulating member 102 fitted to the inside portion of the main metal shell 101 such that the leading end of the insulating member 102 projects over the main metal shell 101; a central electrode 103 disposed in the insulating member 102 such that the leading end of the central electrode 103 projects over the insulating member 102; and a ground electrode 104 disposed such that an end of the ground electrode 104 is connected to the main metal shell 101 and another end of the same is opposite to the central electrode 103. A spark discharge gap g is formed between the ground electrode 104 and the central electrode 103.

The insulating member 102 is constituted by, for example, sintered ceramic material, such as alumina or aluminum nitride and structured to include a through hole 106 formed in the axial direction of the insulating member 102 to receive the central electrode 103. A metal terminal 113 is inserted and secured to either end portion of the through hole 106, while the central electrode 103 is inserted and secured to another end portion of the through hole 106. A different-diameter portion 115 is, in the through hole 106, disposed between the metal terminal 113 and the central electrode 103. Two ends of the different-diameter portion 115 are, through conductive glass sealing layers 116 and 117, electrically connected to the central electrode 103 and the metal terminal 113, respectively.

The main metal shell 1 made of metal, such as carbon steel, is formed into a cylindrical shape. Moreover, a thread portion 107 is formed on the outer surface of the main metal shell 101 to join the plug 100 to an engine block (not shown). Reference numeral 101*e* represents a tool engaging portion to which a tool, such as a spanner or a wrench, is engaged when the main metal shell 101 is joined, the tool engaging portion 101*e* being formed into a hexagonal cross section in the axial direction. On the other hand, an annular line packing 162 arranged to be engaged to rear periphery of a flange-shape projection 102*e* is disposed between the inner surface of the rear opening of the main metal shell 101 and the outer surface of the insulating member 102. Moreover, an annular packing 160 is disposed at the rear of the packing 162 through a filler layer 161 made of talc or the like. The insulating member 102 is pushed forwards toward the main metal shell 101. In the foregoing state, an end of the opening of the main metal shell 101 is inwards crimped toward the packing 160 so that a crimping portion 101*d* is formed. Thus, the main metal shell 101 is secured to the insulating member 102.

A gasket 130 is fitted to the base portion of the thread portion 107 of the main metal shell 101. The gasket 130 is an annular member obtained by bending a plate metal material, such as carbon steel. When the thread portion 107 is screwed in the thread hole of the cylinder head, the gasket 130 is compressed and deformed as if it is crushed at a position between a flange-shape gas sealing portion 101*f* provided for the main metal shell 101 and the periphery of the opening of the thread hole. Thus, a gap between the thread hole and the thread portion 107 is sealed by the gasket 130.

Then, a zinc-plated layer 141 (a zinc-type plated layer) for preventing corrosion is formed on the overall outer surface of a base layer (made of, for example, carbon steel) 140 of the main metal shell 101. Moreover, the outer surface of the zinc-plated layer 141 is covered with a chromate film 142. Similarly, the zinc-plated layer 145 and the chromate film 146 are formed on the outer surface of the gasket 130. Both of the zinc-plated layer and the chromate film are formed by the same method. Therefore, the portion on the main metal shell 101 will representatively be described.

The zinc-plated layer 141 is formed by a known electrolytic zinc plating method to have a thickness of about 3 $\mu$m to about 10 $\mu$m. When the thickness is smaller than 3 $\mu$m, a satisfactory anti-corrosion characteristic cannot sometimes be maintained. When the thickness is larger than 10 $\mu$m, the thickness is too large from a viewpoint of improving the anti-corrosion characteristic. Moreover, time required to complete the plating operation is elongated excessively, causing the manufacturing efficiency to deteriorate. Thus, the manufacturing cost cannot be reduced.

The chromate film 142 contains chrome components in which the ratio of trivalent chrome is 95 wt % or more, the chromate film 142 having a thickness of 0.2 $\mu$m to 0.5 $\mu$m. It is preferable that the chrome components contain trivalent chrome in a maximum quantity. It is furthermore preferable that the overall chrome components is the trivalent chrome component.

Figure 2B:
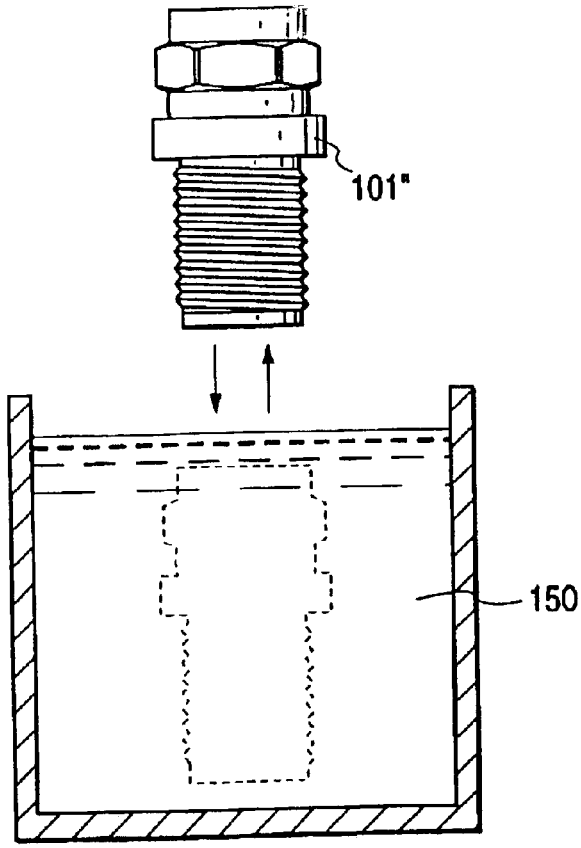
FIG. 2B is a diagram showing a chromate process of a spark plug.

FIG. 2B schematically shows a method of forming the chromate film 142. That is, the main metal shell 101" having the zinc-plated layer having a predetermined thickness by the known electrolytic zinc plating method or the like is immersed in a chromate processing bath 150. The structure of the chromate processing bath 150 has been described. Thus, as shown in FIG. 1C, the chromate film 142 is formed on the surface of the zinc-plated layer 141 of the main metal shell 101. FIG. 2B is a schematic view showing the foregoing process. Although the drawing shows a process that the main metal shell 101 is simply immersed in the chromate processing bath 150. In actual, the known barrel method (a process with which the main metal shells in an unpackaged state are introduced into a liquid permeable container and the process is performed while the container is being rotated in the processing bath 150) or the like may be employed.

The main metal shell 101 subjected to the chromate process is cleaned with water and dried, and then the main metal shell 101 is introduced into the spark plug 100 shown in FIG. 1C. Then, the gasket 130 is used to join the main metal shell 101 to the engine. The main metal shell 101 or the gasket 130 has the chromate film formed on the zinc-plated layer formed and arranged to have the anti-corrosion performance and the heat resistance far superior to that of the conventional trivalent chrome type chromate film or the yellow chromate film. Thus, satisfactory durability against corrosion can be imparted to the zinc-plated layer. Results of experiments performed to confirm the effects will now be described.

EXAMPLES

Results of experiments performed to confirm the effects will now be described.

Example 1

Carbon steel wire SWCH8A for cold forging conforming to JIS G3539 was employed as a material so that the elongated main metal shell 101 having the shape shown in FIG. 1C was manufactured by cold forging. Note that the nominal size of the thread portion 107 of the main metal shell 101 was 14 mm and the axial directional length was about 19 mm. Then, the main metal shell 101 was subjected to an electrolytic zinc plating process using the known alkaline cyanide bath so that a zinc-plated layer having a thickness of 6 $\mu$m was formed.

The chromate processing bath 150 shown in FIG. 2B was prepared by dissolving 50 g of chrome chloride (III) ($CrCl_3.6H_2O$), 3 g of cobalt nitrate (II)($NO_3)_2$), 100 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell having the zinc-plated layer was immersed in the chromate processing solution 50 for 60 seconds. Then, the main metal shell was cleaned with water and dried. Then, drying with hot air, the temperature of which was 80° C., was performed so that a chromate film was formed (sample (1): example).

Figure 11A:
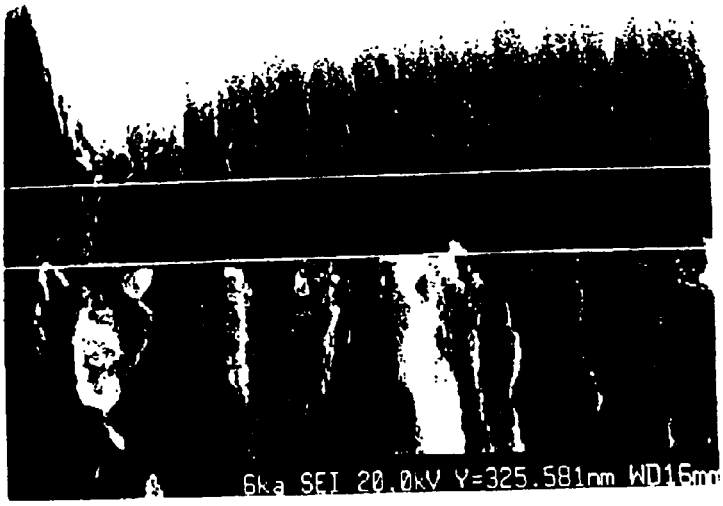
FIGS. 11A to 11C show SEM images of cross sections of the samples employed in Example 1.
Figure 11B:
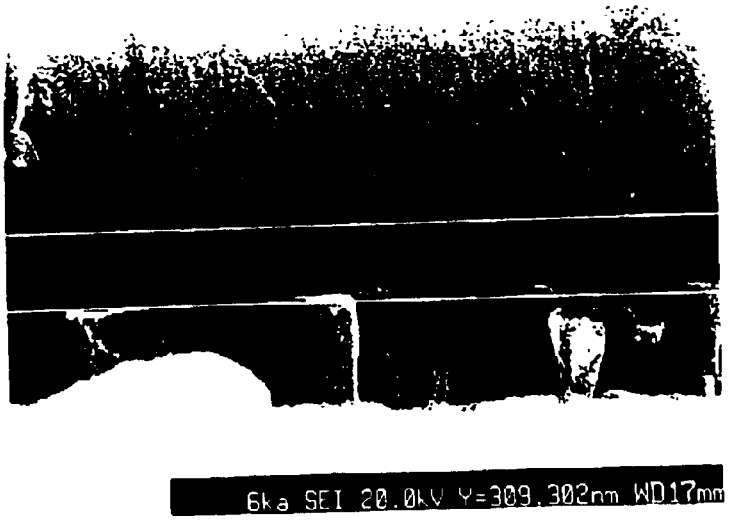
Figure 11C:
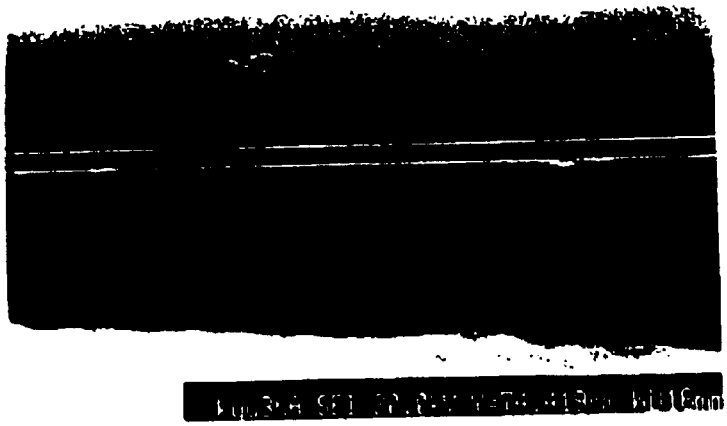

A yellow chromate processing bath was prepared in which 7 g/litter of chromate anhydride, 3 g/litter of sulfuric acid and 3 g/litter of nitric acid were dissolved in deionized water. The temperature of the bath was maintained at 20° C. The main metal shell was immersed in the bath for about 15 seconds, and then the main metal shell was raised and dried so that the yellow chromate film was formed (sample (2): comparative example). A glossy chromate processing bath was prepared in which 3 g/litter of potassium chromium sulfate, 4 g/litter of nitric acid and 2 g/litter of hydrofluoric acid were dissolved in deionized water. The temperature of the bath was maintained at 20° C. The main metal shell was immersed in the bath for about 15 seconds, and then the main metal shell was raised and dried so that a glossy chromate film was formed (sample (3): comparative example). The thickness of the chromate film of each sample was measured in a cross section obtained by an SEM. The thickness of sample (1) was 0.33 $\mu$m, that of sample (2) was 0.31 $\mu$m and that of sample (3) was 0.07 $\mu$m. The cross sectional SEM images employed to measure the thickness were shown in FIGS. 11A to 11C. FIG. 11A shows the SEM image of sample (1), FIG. 11B shows the SEM image of sample (2) and FIG. 11C shows the SEM image of sample (3). To facilitate observation of the chromate film, a thin Au film was formed on the surface of the film by a sputtering method. Since the chromate film having a low conductivity as compared with the base zinc-plated layer and the thin Au film each having a high conductivity forms a dark image in the SEM image, the image of the chromate film can easily be detected in accordance with the difference in the contrast. In each SEM image, a white line is drawn at the position corresponding to the boundaries among the chromate film, the zinc-plated layer and the Au layer confirmed in accordance with the contrast. In accordance with the distance between the white lines, the thickness is determined.

Figure 3:
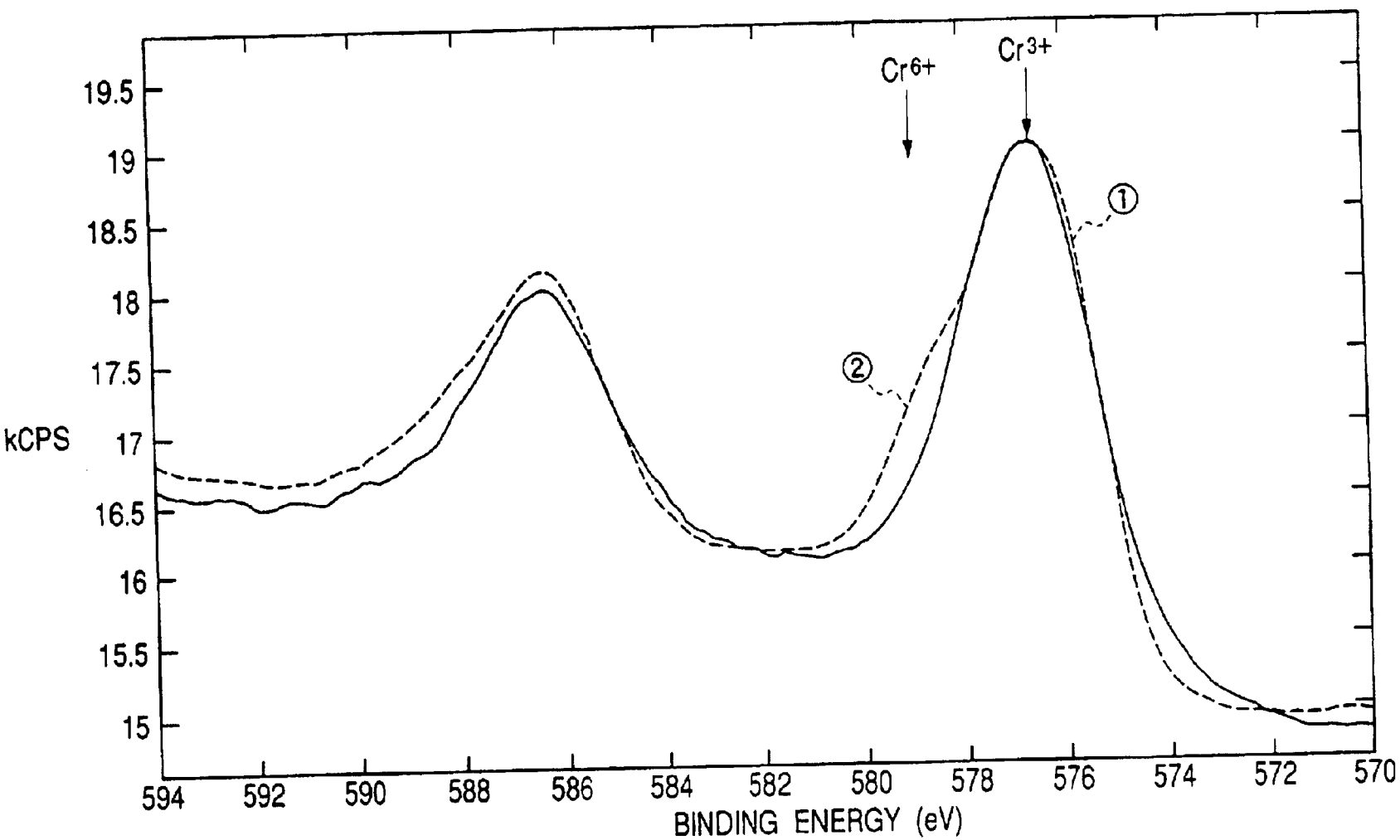
FIG. 3 is a graph (a peak portion of chrome ($2p_{2/3}$) of the photoelectron spectrum) showing results of X-ray photoelectron spectrum analysis of a chromate film of each of samples (1) and (2) according to Example 1.

A state of presence of chrome in each of the formed chromate films was examined by an X-ray photospectral analysis (XPS) method. FIG. 3 shows peaks of chrome (2 p2/3) in the photospectrum of samples (1) and (2). Sample (1) (indicated with a solid line) was free of a peak at the position corresponding to hexavalent chrome Thus, a major portion of the chrome components was trivalent chrome. On the other hand, sample (2) had the peak of trivalent chrome on which the peak of hexavalent chrome was superimposed. Thus, a raised portion was detected in the high energy portion f the peak.

Figure 4:
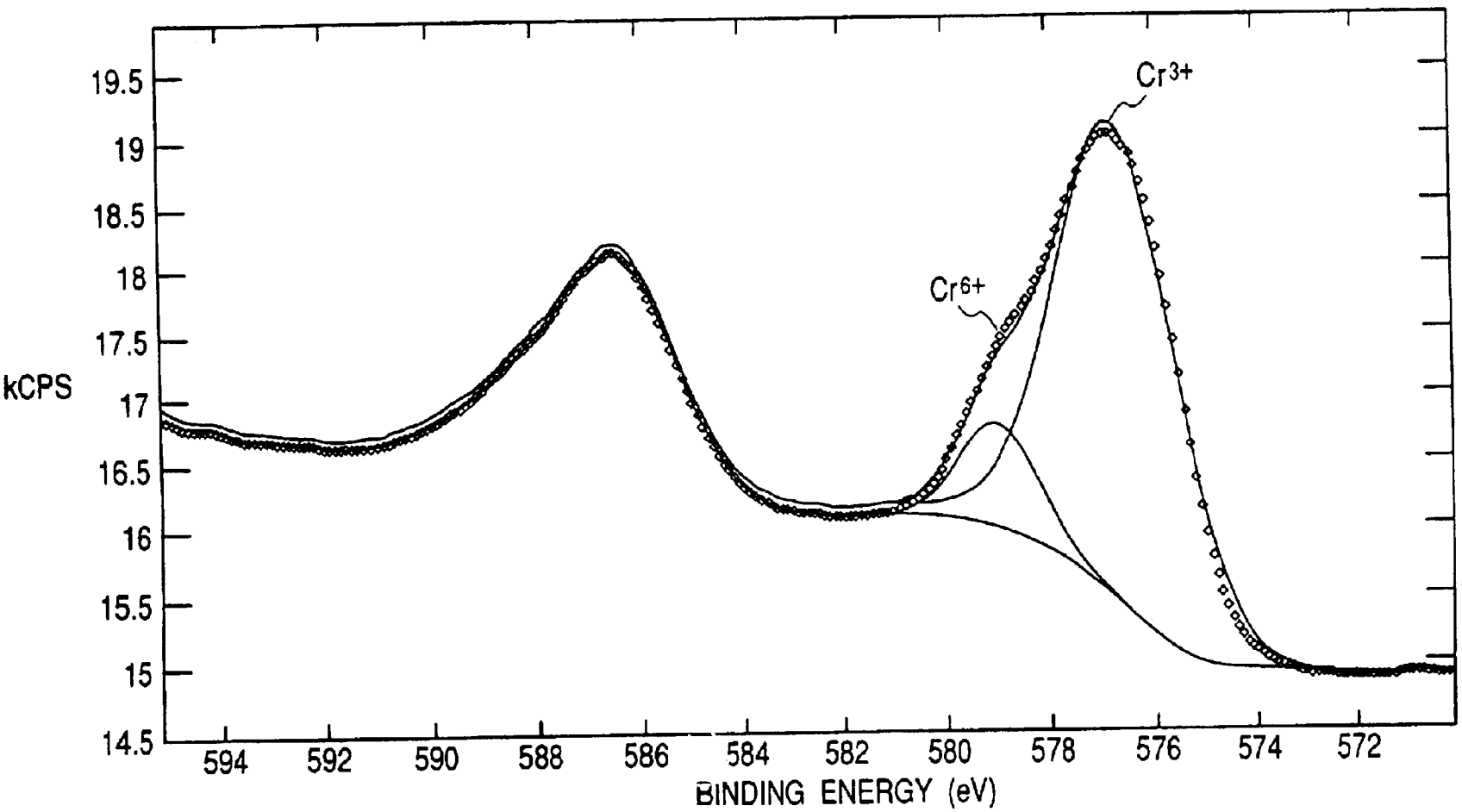
FIG. 4 a graph showing results of peak separation analysis of the peak portion of chrome ($2p_{2/3}$) of the photoelectron spectrum analysis of sample (2) of Example 1.

FIG. 4 shows results of peak separation analysis of the shape of each peak performed such that an assumption is made that the intensity of the photoelectron X-ray was I (axis of ordinate: cps) and the bond energy was x (axis of abscissa: eV). Then, approximation with the following equation was performed:

$$I=\exp\{-(x-\mu)^2/2\sigma^2\} \quad (1)$$

where $\mu$ is x coordinate of the peak and $\sigma$ is a half width of the peak curve).

According to the results, assuming that the height of the peak of trivalent chrome was I1 and that of sixilaent chrome was I2, I2/(I1+I2) was about 0.2 (it is preferable that I2/(I1+I2) is 0.05 or smaller to reduce the quantity of hexavalent chrome). A dichromatic sesquioxide standard reference material was used to make an analytical curve to calculate the weight-content of hexavalent chrome in the overall quantity of the chrome components. A fact was detected that about 15 wt % was hexavalent chrome and the residue was trivalent chrome. Also samples (1) and (3) were similarly analyzed, resulting in that substantially the overall portion of the chrome components was trivalent chrome.

Figure 5:
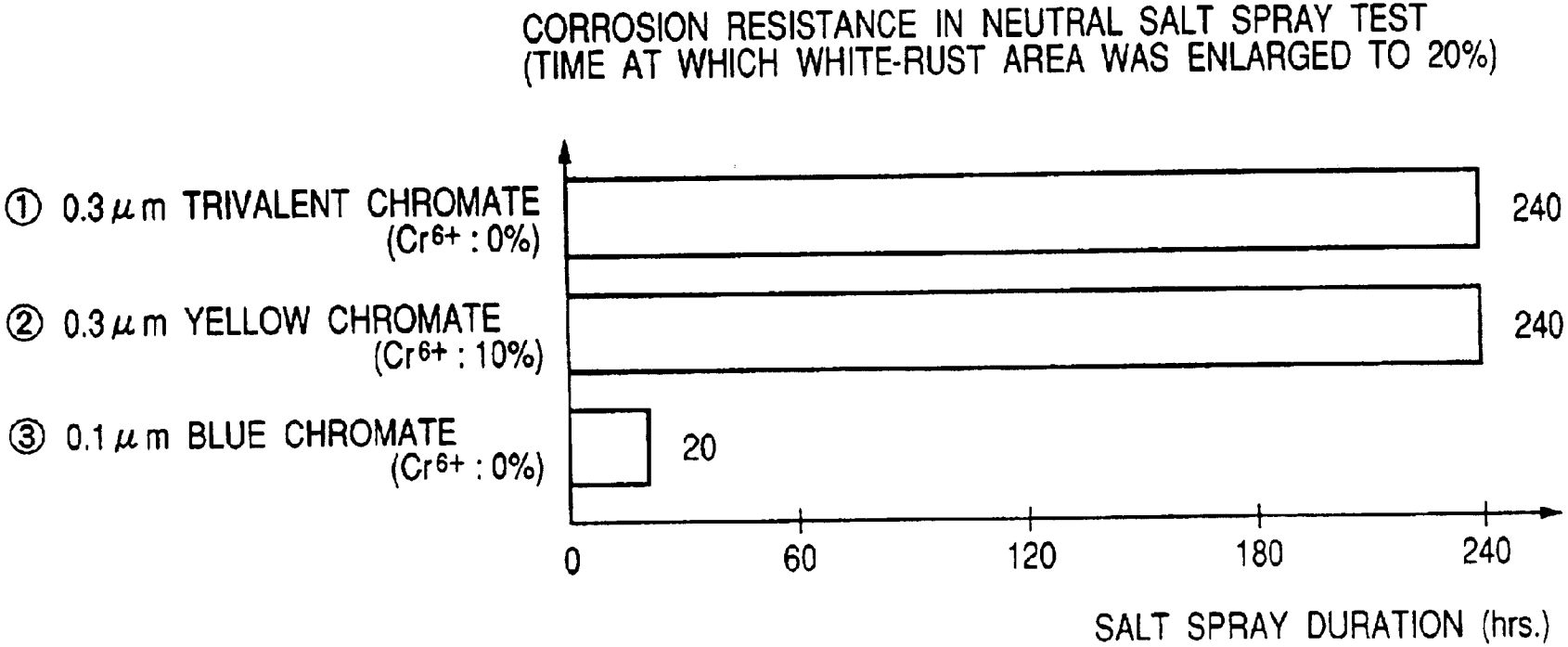
FIG. 5 is a graph showing results of a neutral salt water spray test to which each sample according to Example 1 was subjected.

Samples (1) to (3) were subjected to chapter five "neutral salt water spray test" of anti-corrosion test of plating conforming to JIS H8502. Thus, time for which white rust appears by about 20% or more of the overall surface caused from corrosion of the zinc-plated film was measured to evaluate the durability. In this specification, the main metal shell was as it is used as the sample. Moreover, the portion (the hexagonal portion) to which the tool was engaged was the surface of the sample. Results were shown in FIG. 5. That is, sample (1) of the main metal shell according to the present invention exhibited a satisfactory durable time of 240 hours. The result was similar to that of sample (2) subjected to the yellow chromate process. The result was about 8 times the result of sample (3) incorporating the conventional thin glossy chromate film.

Figure 6:
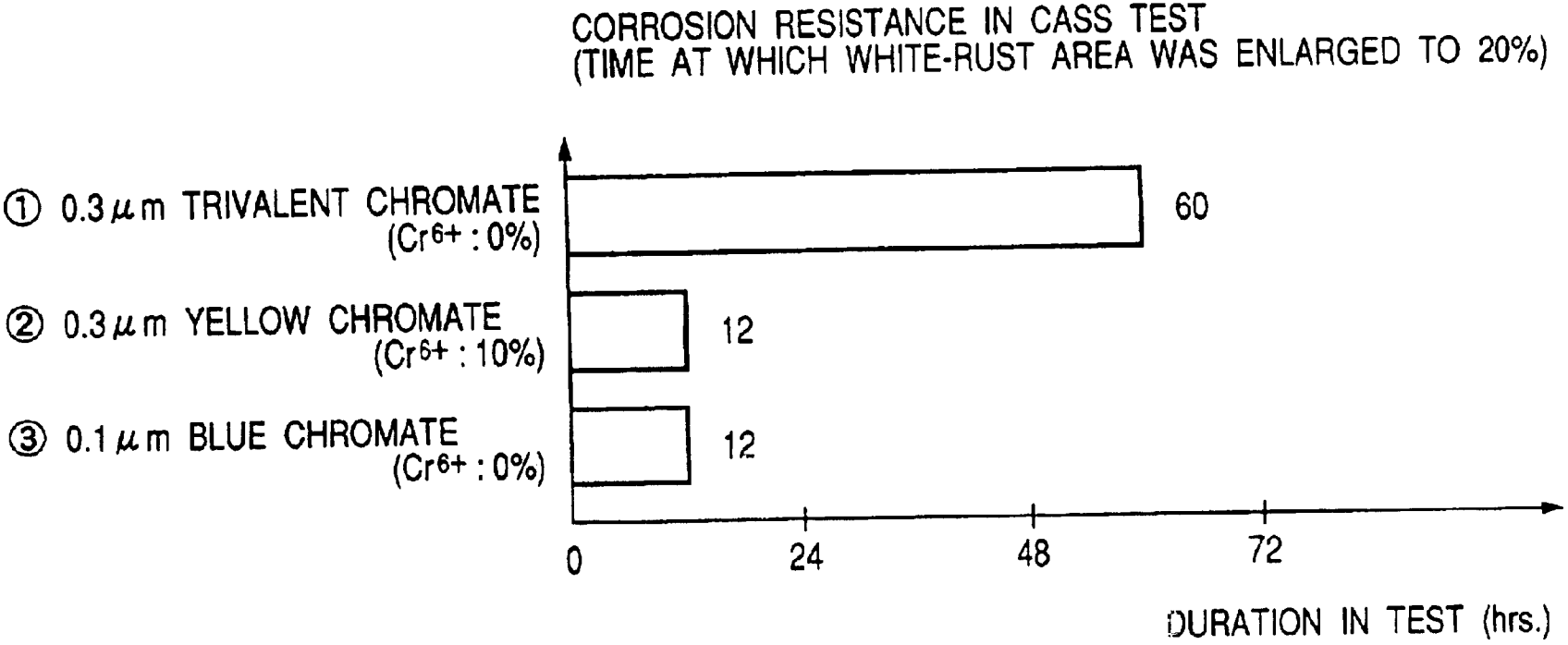
FIG. 6 is a graph showing results of CASS tests in Example 1.
Figure 7:
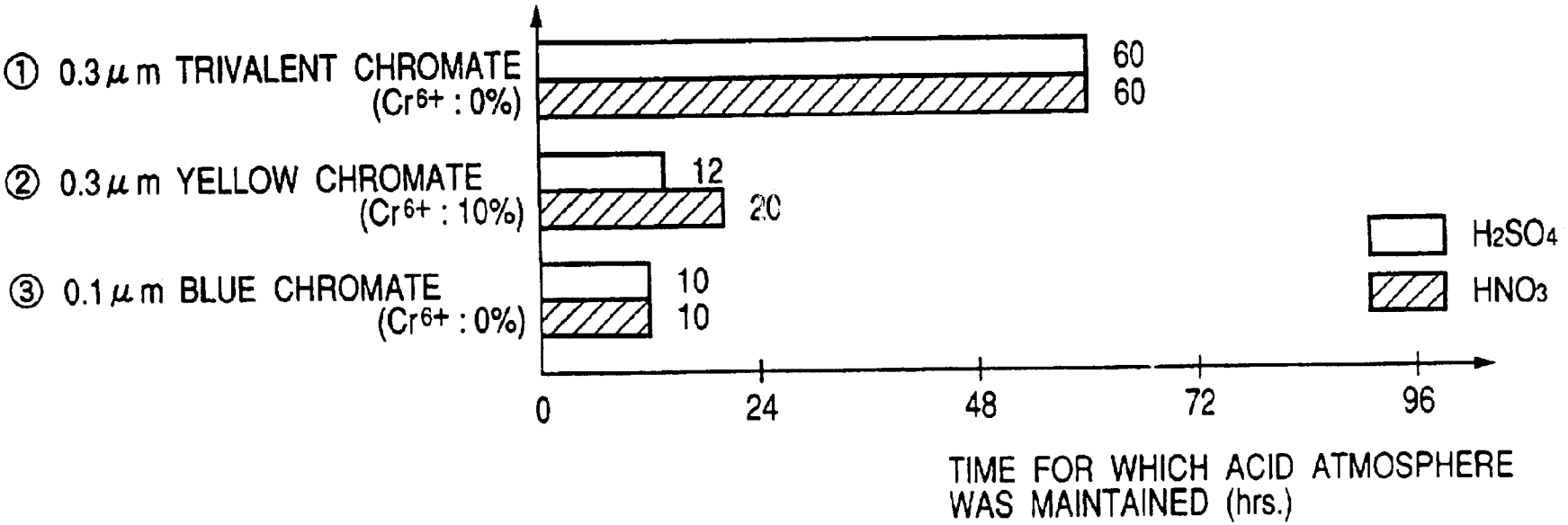
FIG. 7 is a graph showing results of acid resistance test in Example 1.

Samples similar to samples (1) to (3) were subjected to chapter seven "CASS test" of anti-corrosion test of plating conforming to JIS H8502. Thus, time for which white rust appears by about 20% or more of the overall surface caused from corrosion of the zinc-plated film was measured to evaluate the durability. Moreover, durability tests each using sulfuric acid and nitric acid were performed as follows: initially, pH2 sulfuric acid solution or nitric acid solution was introduced into a desiccator. Then, each sample was enclosed in the desiccator such that the sample was not directly brought into contact with the acid solution and contact with steam of the solution was permitted. The temperature of the desiccator was allowed to stand in a constant-temperature tank set to 90° C. to perform an evaluation in accordance with a similar criterion to that of the CASS test. Results were shown in FIGS. 6 and 7. In each test, sample (2) subjected to the yellow chromate process and sample (3) subjected to the glossy chromate process resulted in short durability time. On the other hand, sample (1) according to the embodiment of the present invention resulted in a satisfactory result of durability.

Figure 8:
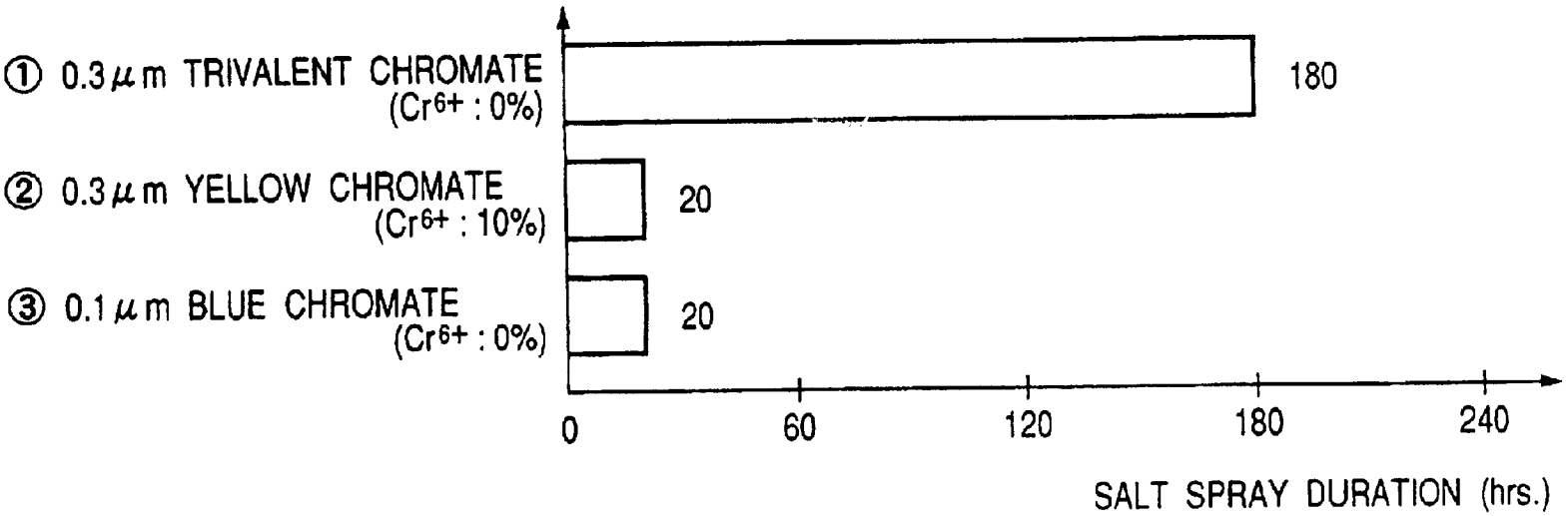
FIG. 8 is a graph showing results of the neutral salt water spray test performed after heating in Example 1.

Then, an actual mounting test was performed such that a spark plug shown in FIG. 1C was manufactured by using the above-mentioned main metal shell. Then, the spark plug was joined to a 6-cylinder and 2000 cc gasoline engine. The engine was continuously operated at engine speed of 5600 rpm for 10 hours in a state in which the throttle was completely opened. Note that the temperature of the main metal shell during the operation was about 200° C. Each sample subjected to the actual mounting test was subjected to a neutral salt water spray test similar to the foregoing test. Results were shown in FIG. 8. Sample (2) subjected to the yellow chromate process and sample (3) subjected to the glossy chromate process resulted in short durability time of about 20 hours. On the other hand, sample (1) according to the embodiment of the present invention resulted in a satisfactorily long durable time of 180 hours after the sample (1) was mounted on the engine.

Each sample was heated to 200° C. in the atmosphere in a constant-temperature tank and the temperature was maintained for 30 minutes. Then, a similar neutral salt spray test was performed. Sample (2) subjected to the yellow chromate process and sample (3) subjected to the glossy chromate process resulted in short durability time of about 20 hours. On the other hand, sample (1) according to the embodiment of the present invention resulted in a satisfactorily long durable time of 200 hours.

Example 2

Figure 9:
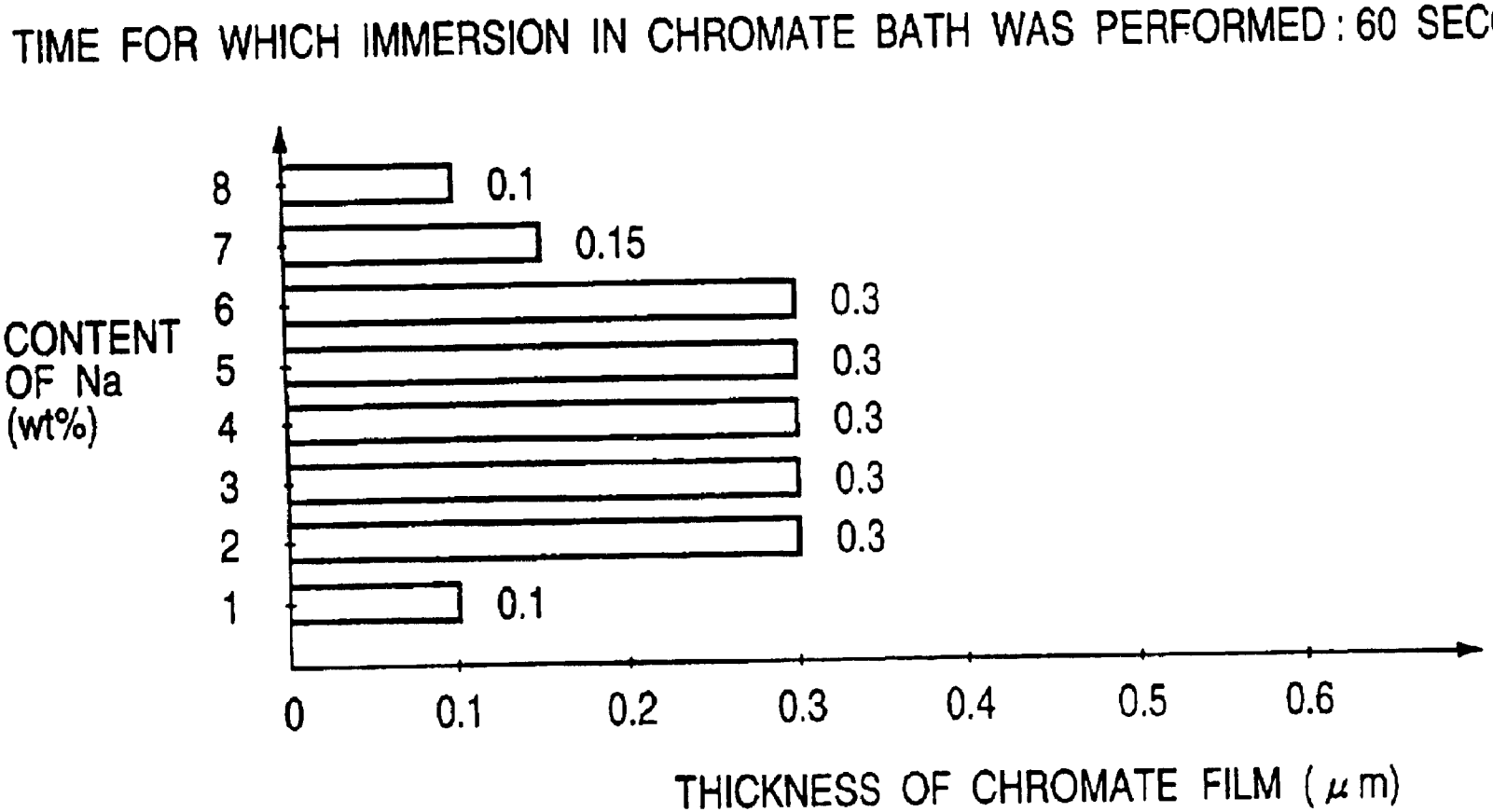
FIG. 9 is a graph showing the relationship between the quantity of Na in the chromate film of the sample according to Example 2 and the thickness of the same.

A main metal shell similar to that according to Example 1 was manufactured under the same conditions until the zinc processing process was performed. Then, a chromate processing bath was prepared by dissolving 50 g of chrome chloride (III) ($CrCl_3.6H_2O$), 3 g of cobalt nitrate (II)($Co(NO_3)_2$), 50 g to 100 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell having the zinc-plated layer was immersed in the chromate processing solution 50 for 60 seconds. Then, the main metal shell was cleaned with water and dried. Then, drying with hot air, the temperature of which was 80° C., was performed so that chromate films having various thicknesses were formed. The thickness of the obtained chromate film was measured by observing the cross section of the SEM similar to Example 1. The content of Na was examined and measured by the X-ray photoelectron spectrum analysis method (XPS). Results were shown in FIG. 9. That is, when the content of Na in the film was 2 wt % to 7 wt %, and in particular, when the same is 2 wt % to 6 wt %, the chromate film having a large thickness was obtained in a relatively short time.

Example 3

Figure 10:
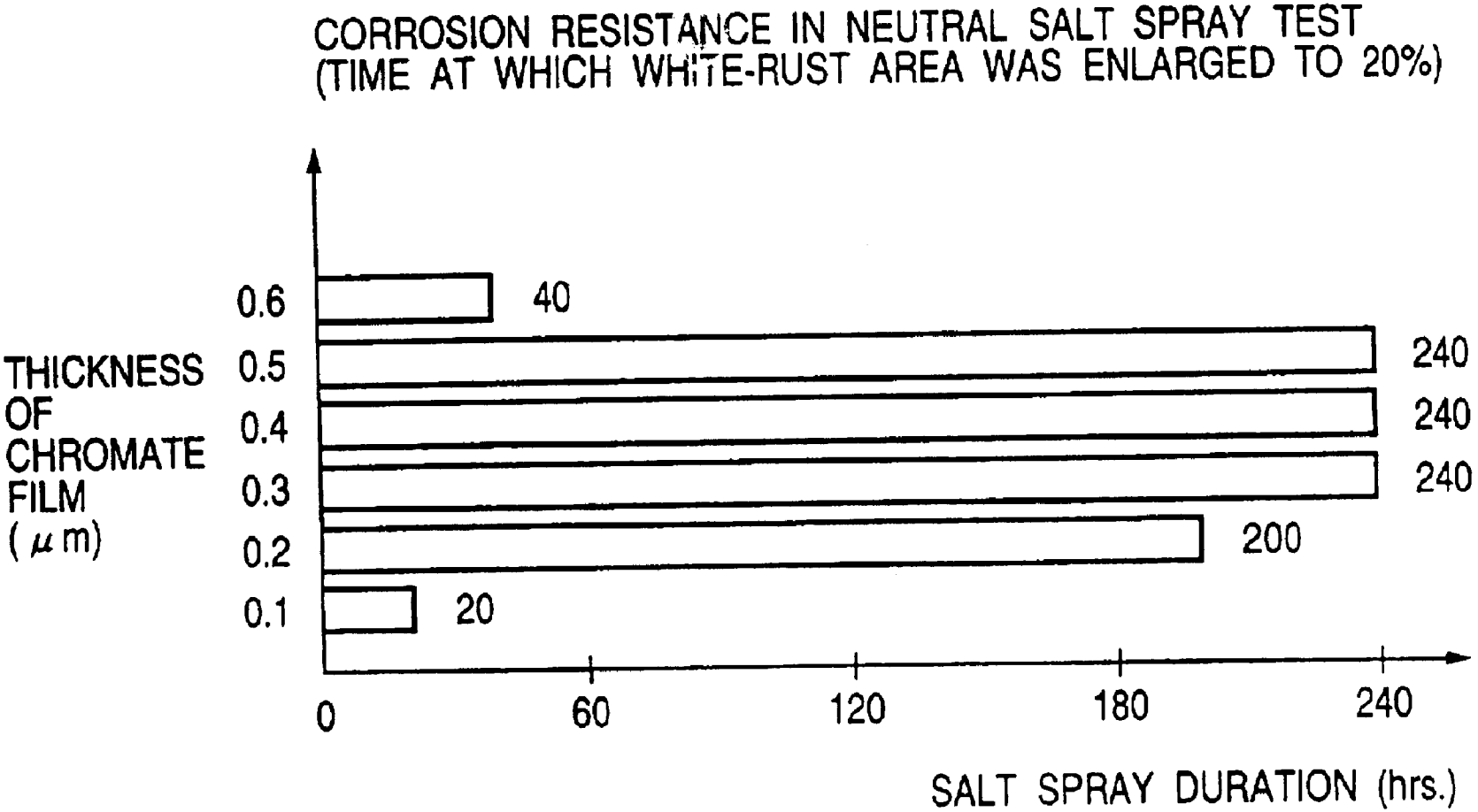
FIG. 10 is a graph showing the relationship between the thickness of the chromate film of the sample according to Example 3 and salt water spray time.

A main metal shell similar to that according to Example 1 was manufactured under the same conditions until the zinc plating process was performed. Then, a bath was prepared by dissolving 50 g of chrome chloride (III) ($CrCl_3.6H_2O$), 3 g of cobalt nitrate (II)($Co(NO_3)_2$), 50 g to 150 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell having the zinc-plated layer was immersed in the chromate processing solution for 40 seconds to 80 seconds. Then, the main metal shell was cleaned with water and dried. Then, drying with hot air, the temperature of which was 80° C., was performed so that chromate films having various thicknesses were formed. Each main metal shell having the chromate film was subjected to the neutral salt water spray test similar to that according to Example 1 to evaluate the chromate film. Results were shown in FIG. 10. When the thickness of the film was 0.2 μm to 0.5 μm, and in particular, when the thickness was 0.3 μm to 0.5 μm, satisfactory durability was realized.

Example 4

A material was STKM13CE conforming to JIS G3445 so that the main metal shell 3 having the shape shown in FIG. 1A was manufactured by cold forging. Note that the nominal size of the thread portion 7 of the main metal shell 3 was 10 mm and the axial directional length was about 51.5 mm. Then, the main metal shell 3 was subjected to an electrolytic zinc plating process using the known alkaline cyanide bath so that a zinc-plated layer having a thickness of 16 μm was formed.

The chromate processing bath 50 shown in FIG. 2A was prepared by dissolving 50 g of chrome chloride (III) ($CrCl_3.6H_2O$), 3 g of cobalt nitrate (II) ($Co(NO_3)_2$), 100 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell 3 having the zinc-plated layer was immersed in the chromate processing solution 50 for 60 seconds. Then, the main metal shell was cleaned with water and dried. Then, drying with hot air, the temperature of which was 80° C., was performed so that a chromate film was formed (sample (1): example).

A yellow chromate processing bath was prepared in which 7 g/litter of chromate anhydride, 3 g/litter of sulfuric acid and 3 g/litter of nitric acid were dissolved in deionized water. The temperature of the bath was maintained at 20° C. The main metal shell was immersed in the bath for about 15 seconds, and then the main metal shell was raised and dried so that the yellow chromate film was formed (sample (2): comparative example). A glossy chromate processing bath was prepared in which 3 g/litter of potassium chromium sulfate, 4 g/litter of nitric acid and 2 g/litter of hydrofluoric acid were dissolved in deionized water. The temperature of the bath was maintained at 20° C. The main metal shell was immersed in the bath for about 15 seconds, and then the main metal shell was raised and dried so that a glossy chromate film was formed (sample (3): comparative example). The thickness of the chromate film of each sample was measured in a cross section obtained by an SEM. The thickness of sample (1) was 0.33 μm, that of sample (2) was 0.31 μm and that of sample (3) was 0.07 μm. The thickness was measured in the same manner as described in Example 1.

Figure 12:
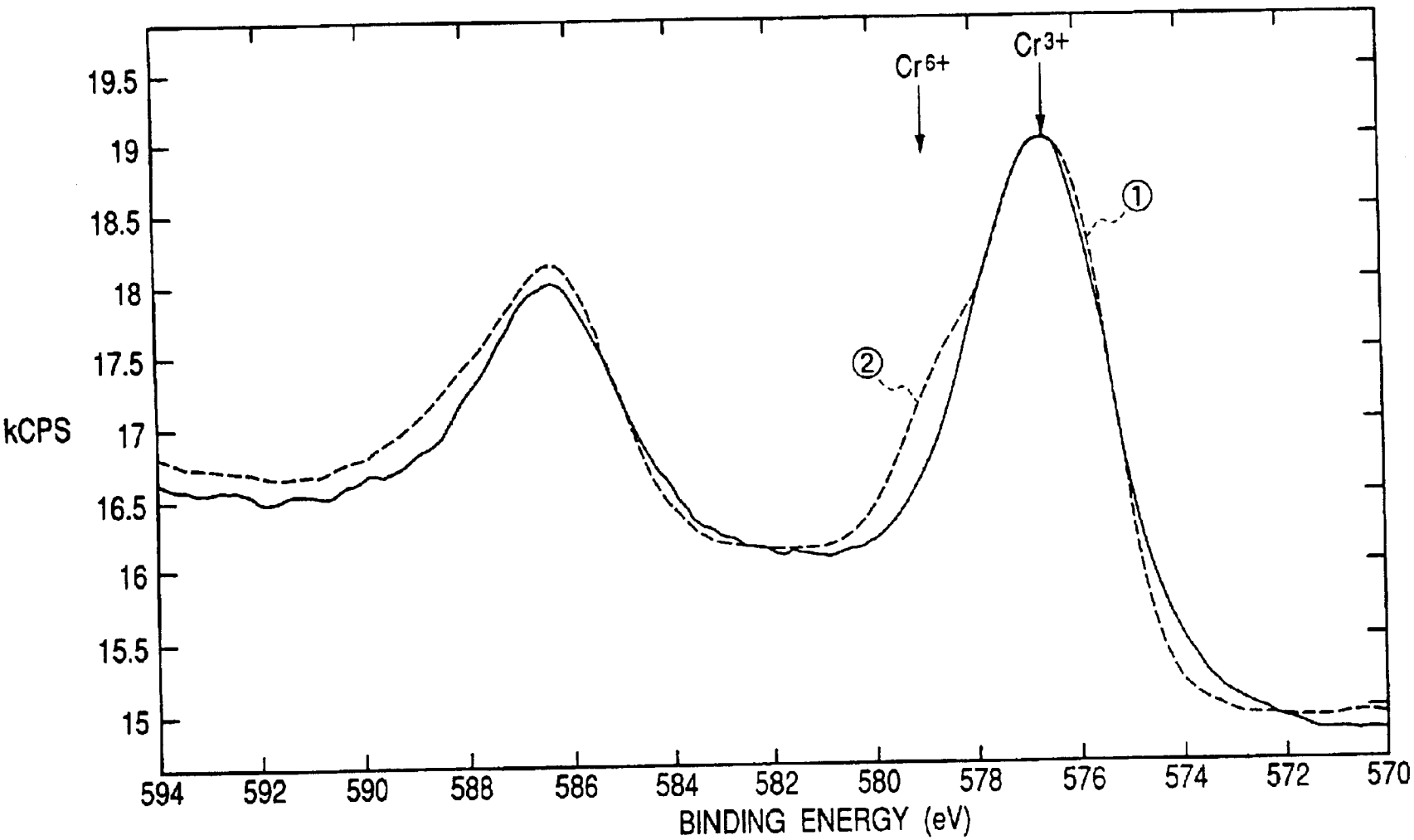
FIG. 12 is a graph (a peak portion of chrome ($2p_{2/3}$) of the photoelectron spectrum) showing results of X-ray photoelectron spectrum analysis of a chromate film of each of samples (1) and (2) according to Example 4.

A state of presence of chrome in each of the formed chromate films was examined by an X-ray photospectral analysis (XPS) method. FIG. 12 shows peaks of chrome (2 p2/3) in the photospectrum of samples (1) and (2). Sample (1) (indicated with a solid line) was free of a peak at the position corresponding to hexavalent chrome. Thus, a major portion of the chrome components was trivalent chrome. On the other hand, sample (2) had the peak of trivalent chrome on which the peak of hexavalent chrome was superimposed. Thus, a raised portion was detected in the high energy portion of the peak.

Figure 13:
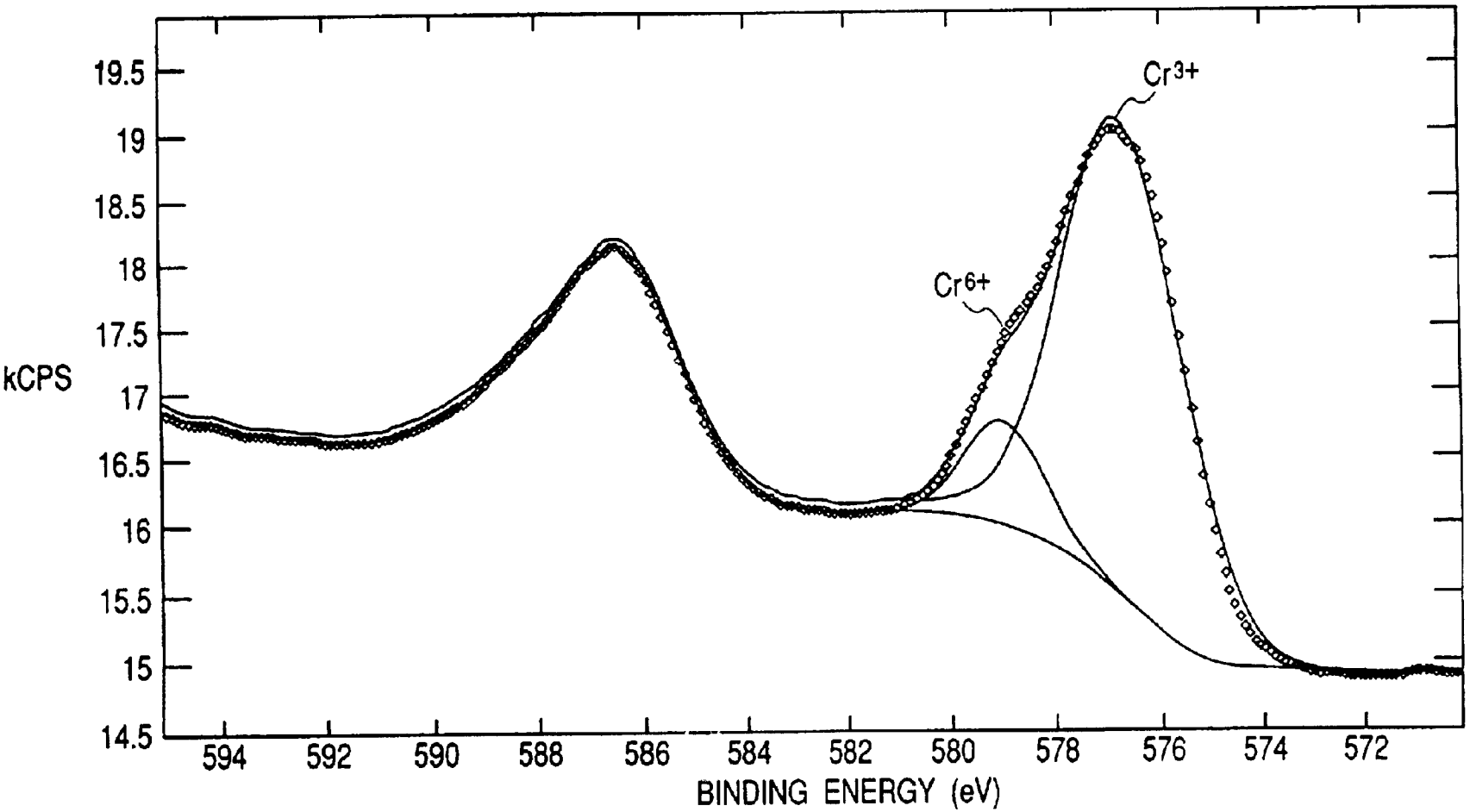
FIG. 13 a graph showing results of peak separation analysis of the peak portion of chrome ($2p_{2/3}$) of the photoelectron spectrum analysis of sample (2) of Example 4.

FIG. 13 shows results of peak separation analysis of the shape of each peak performed such that an assumption is made that the intensity of the photoelectron X-ray was I (axis of ordinate: cps) and the bond energy was x (axis of abscissa: eV). Then, approximation with the following equation was performed:

$$I=\exp\{-(x-\mu)^2/2\sigma^2\} \quad (1)$$

where $\mu$ is x coordinate of the peak and $\sigma$ is a half width of the peak curve).

According to the results, assuming that the height of the peak of trivalent chrome was I1 and that of hexavalent chrome was I2, I2/(I1_I2) was about 0.2 (it is preferable that I2/(I1_I2) is 0.05 or smaller to reduce the quantity of hexavalent chrome). A dichromatic sesquioxide standard reference material was used to make an analytical curve to calculate the weight-content of hexavalent chrome in the overall quantity of the chrome components. A fact was detected that about 15 wt % was hexavalent chrome and the residue was trivalent chrome. Also samples (1) and (3) were similarly analyzed, resulting in that substantially the overall portion of the chrome components was trivalent chrome.

Figure 14:
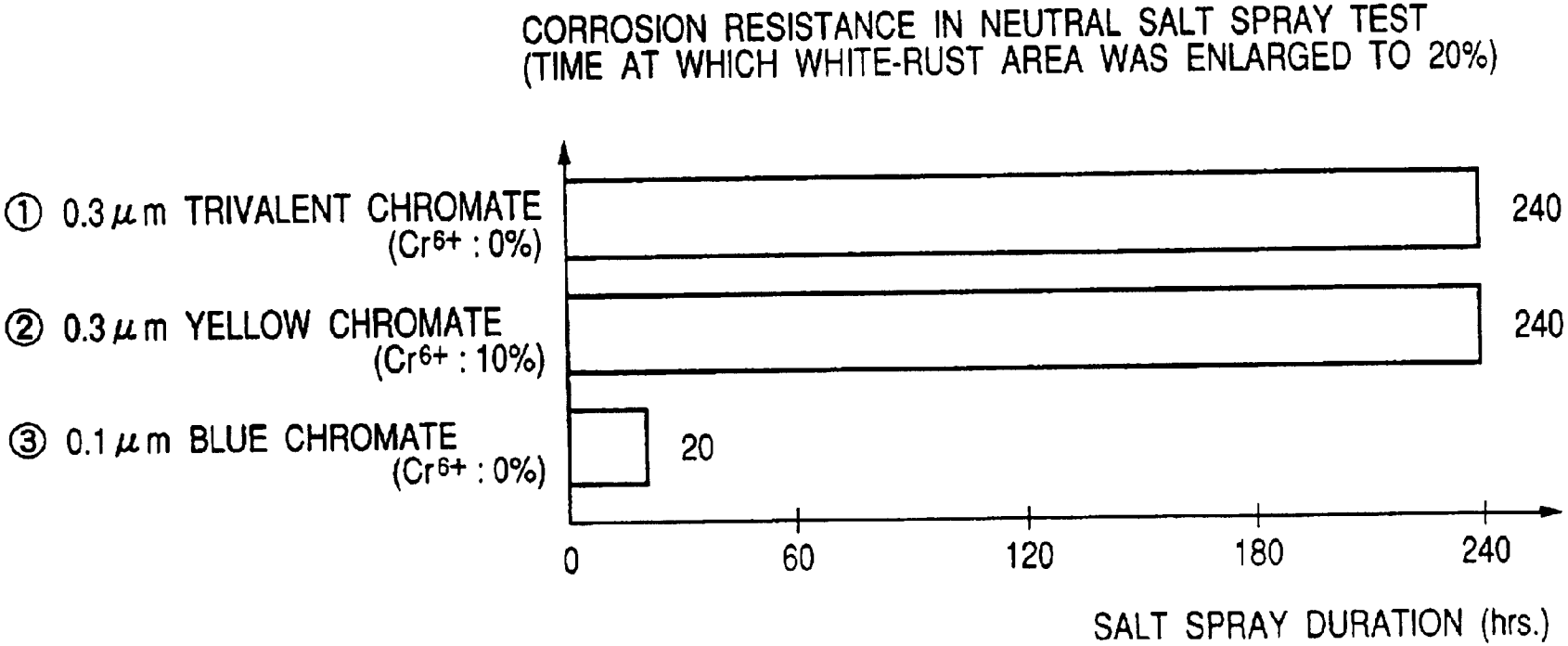
FIG. 14 is a graph showing results of a neutral salt water spray test to which each sample according to Example 4 was subjected.

Samples (1) to (3) were subjected to chapter five "neutral salt water spray test" of anti-corrosion test of plating conforming to JIS H8502. Thus, time for which white rust appears by about 20% or more of the overall surface caused from corrosion of the zinc-plated film was measured to evaluate the durability. In this specification, the main metal shell was as it is used as the sample. Moreover, the portion (the hexagonal portion) to which the tool was engaged was the surface of the sample. Results were shown in FIG. 14. That is, sample (1) of the main metal shell according to the present invention and satisfying the requirements for the glow plug exhibited a satisfactory durable time of 240 hours. The result was similar to that of sample (2) subjected to the yellow chromate process. The result was about 8 times the result of sample (3) incorporating the conventional thin glossy chromate film.

Figure 15:
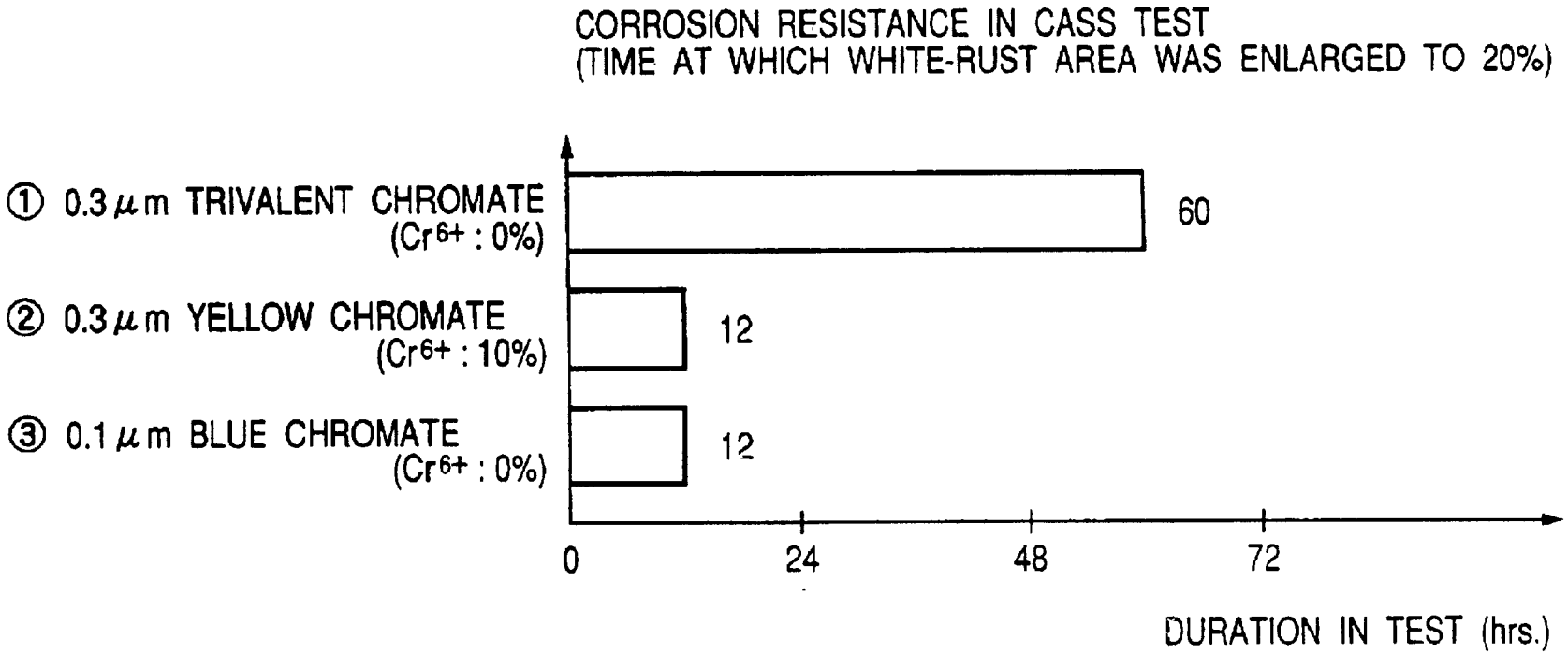
FIG. 15 is a graph showing results of CASS tests in Example 4.
Figure 16:
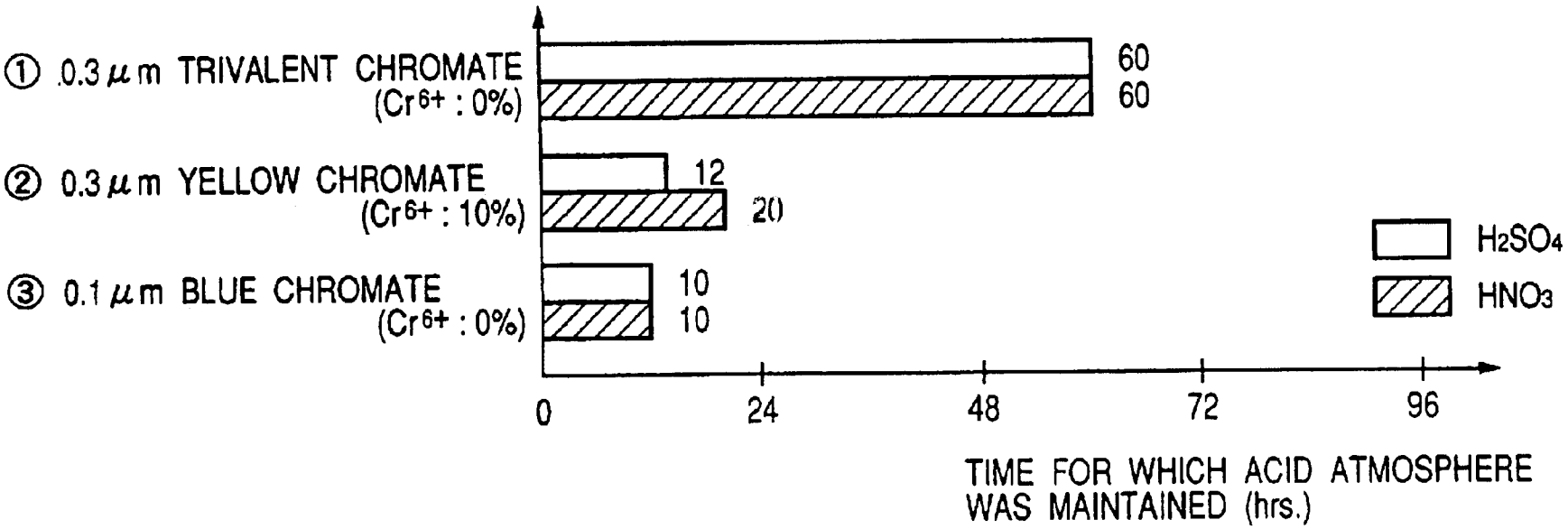
FIG. 16 is a graph showing results of acid resistance test in Example 4.

Samples similar to samples (1) to (3) were subjected to chapter seven "CASS test" of anti-corrosion test of plating conforming to JIS H8502. Thus, time for which white rust appears by about 20% or more of the overall surface caused from corrosion of the zinc-plated film was measured to evaluate the durability. Moreover, durability tests each using sulfuric acid and nitric acid were performed as follows: initially, pH2 sulfuric acid solution or nitric acid solution was introduced into a desiccator. Then, each sample was enclosed in the desiccator such that the sample was not directly brought into contact with the acid solution and contact with steam of the solution was permitted. The temperature of the desiccator was allowed to stand in a constant-temperature tank set to 90° C. to perform an evaluation in accordance with a similar criterion to that of the CASS test. Results were shown in FIGS. 15 and 16. In each test, sample (2) subjected to the yellow chromate process and sample (3) subjected to the glossy chromate process resulted in unsatisfactory short durability time. On the other hand, sample (1) according to the embodiment of the present invention resulted in a satisfactory result of durability.

Figure 17:
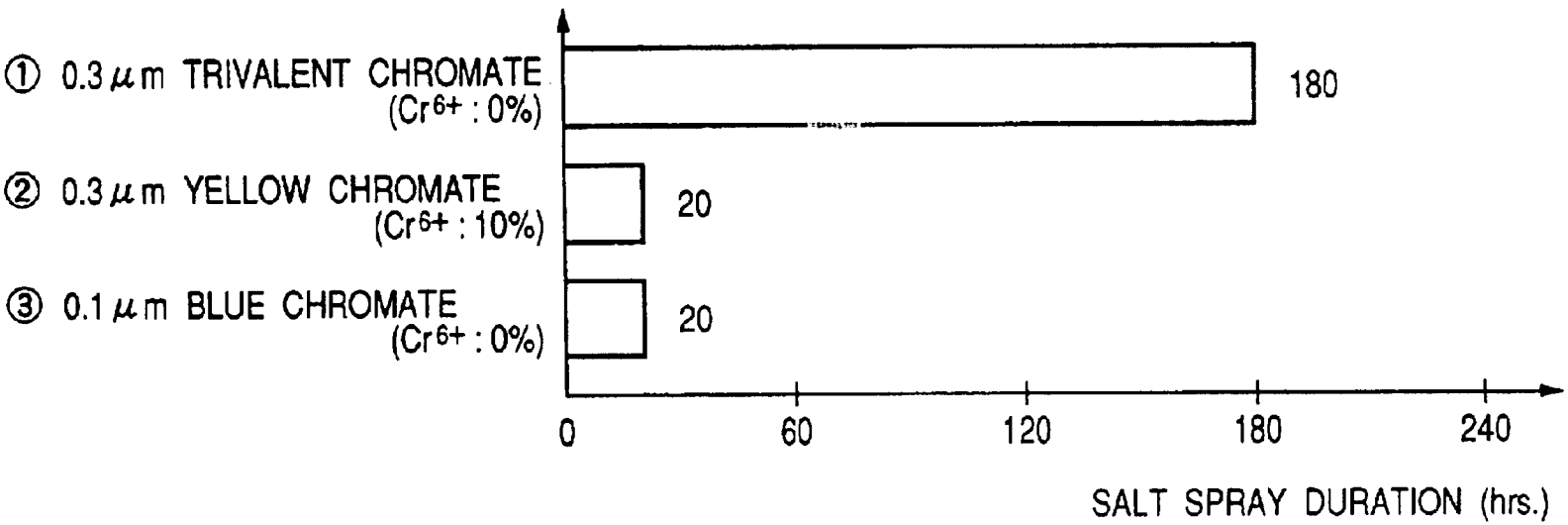
FIG. 17 is a graph showing results of the neutral salt water spray test performed after heating in Example 4.

Each sample was heated to 200° C. for 30 minutes in the atmosphere, and then, a similar neutral salt spray test was performed. Results were shown in FIG. 17. Sample (2) subjected to the yellow chromate process and sample (3) subjected to the glossy chromate process resulted in short durability time of about 20 hours. On the other hand, sample (1) according to the embodiment of the present invention resulted in a satisfactorily long durable time of 200 hours after the heating.

Example 5

Figure 18:
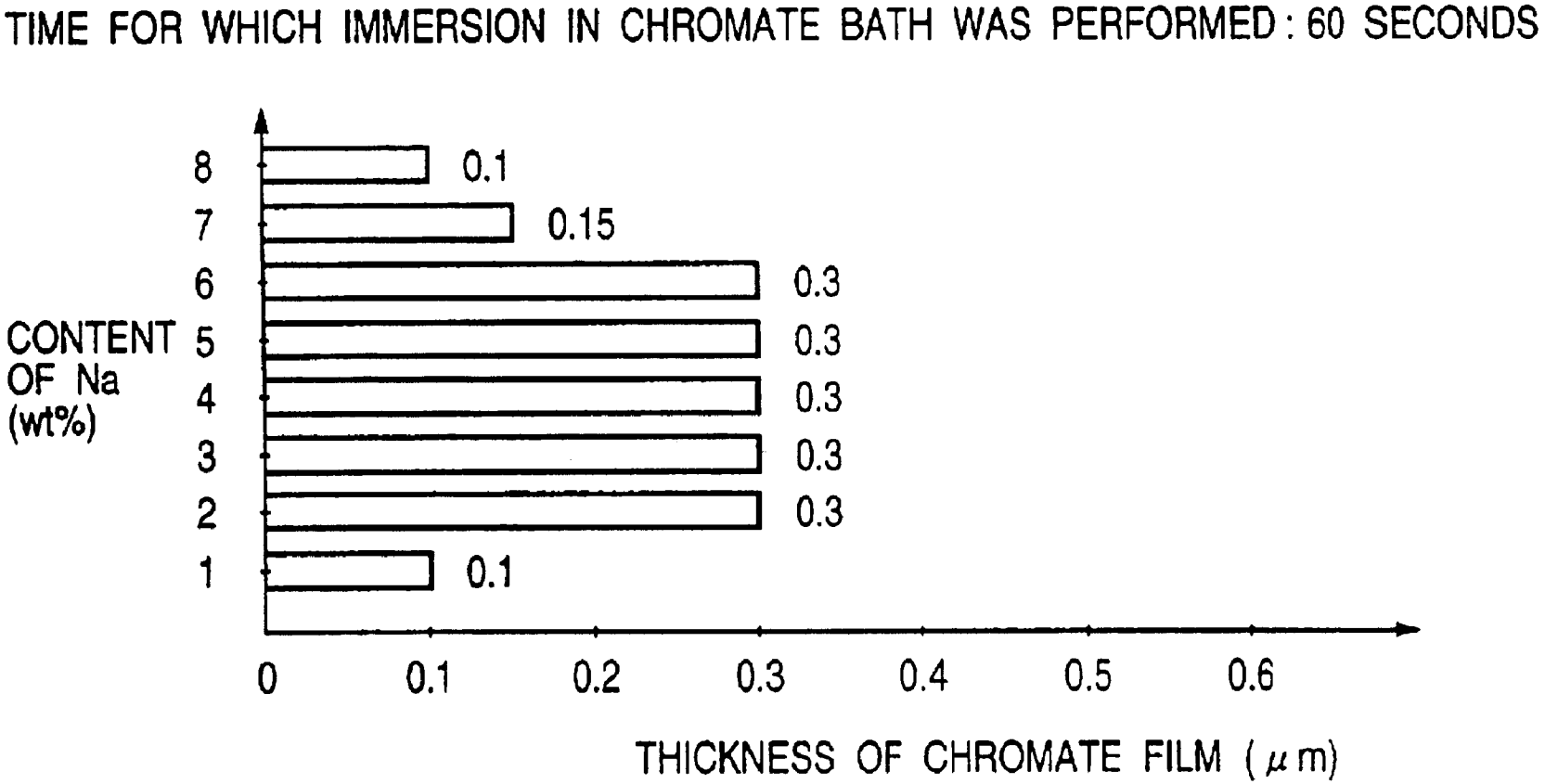
FIG. 18 is a graph showing the relationship between the quantity of Na in the chromate film of the sample according to Example 5 and the thickness of the same.

A main metal shell similar to that according to Example 4 was manufactured under the same conditions until the zinc processing process was performed. Then, a chromate processing bath was prepared by dissolving 50 g of chrome chloride (III) ($CrCl_3.6H_2O$), 3 g of cobalt nitrate (II)(Co $(NO_3)_2$), 50 g to 150 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell having the zinc-plated layer was immersed in the chromate processing solution 50 for 60 seconds. Then, the main metal shell was cleaned with water and dried. Then, drying with hot air, the temperature of which was 80° C., was performed so that chromate films having various thicknesses were formed. The thickness of the obtained chromate film was measured by observing the cross section of the SEM similar to Example 1. The content of Na was measured by ESCA. Results were shown in FIG. 18. That is, when the content of Na in the film was 2 wt % to 7 wt %, and in particular, when the same is 2 wt % to 6 wt %, the chromate film having a large thickness was obtained in a relatively short time.

Example 6

Figure 19:
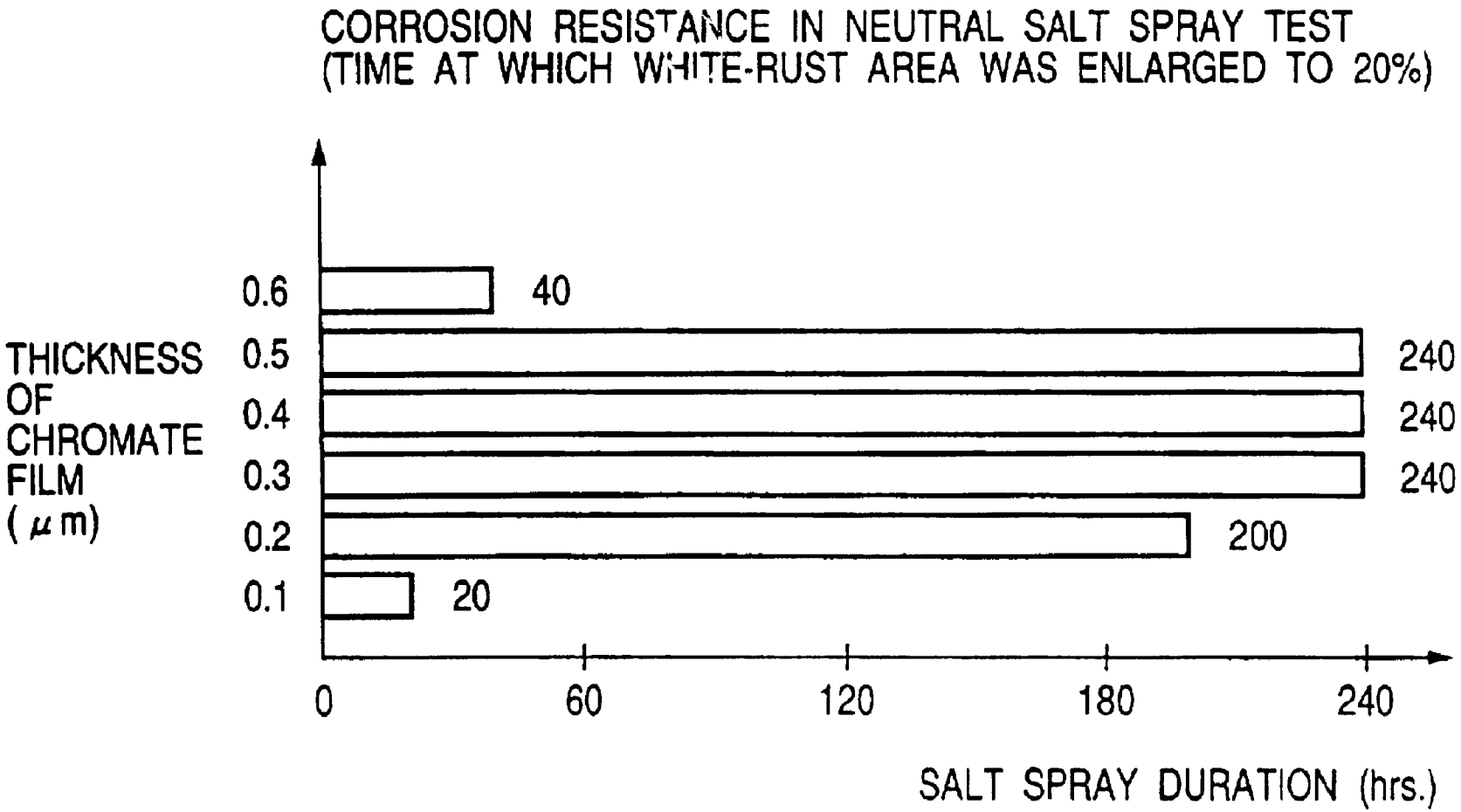
FIG. 19 is a graph showing the relationship between the thickness of the chromate film of the sample according to Example 6 and salt water spray time.

A main metal shell similar to that according to Example 1 was manufactured under the same conditions until the zinc plating process was performed. Then, a bath was prepared by dissolving 50 g of chrome chloride (III) ($CrCl_3.6H_2O$), 3 g of cobalt nitrate (II)(Co $(NO_3)_2$), 50 g to 150 g of sodium nitrate ($NaNO_3$) and 31.2 g of malonic acid with respect to one litter of deionized water. Then, the temperature of the solution was maintained at 60° C. by operating a heater. Moreover, the pH of the bath was adjusted to 2.0 by adding caustic soda solution. The main metal shell having the zinc-plated layer was immersed in the chromate processing solution for 40 seconds to 80 seconds. Then, the main metal shell was cleaned with water and dried. Then, drying with hot air, the temperature of which was 80° C., was performed so that chromate films having various thicknesses were formed. Each main metal shell having the chromate film was subjected to the neutral salt water spray test similar to that according to Example 4 to evaluate the chromate film. Results were shown in FIG. 19. When the thickness of the film was 0.2 $\mu$m to 0.5 $\mu$m, and in particular, when the thickness was 0.3 $\mu$m to 0.5 $\mu$m, satisfactory durability was realized.

What is claimed is:

1. A method of manufacturing a spark plug incorporating a central electrode, an insulating member disposed on the outside of said central electrode, a main metal shell disposed on the outside of said insulating member and a ground electrode disposed opposite to said central electrode to form a spark discharge gap, said method of manufacturing a spark plug comprising the step of:

immersing said main metal shell in a chromate processing bath containing trivalent chrome salt and a complexing agent for said trivalent chrome mixed therein so that a chromate film containing trivalent chrome by 95 wt % or more of contained chrome components and having a thickness of 0.2 $\mu$m to 0.5 $\mu$m is formed on the surface of said main metal shell.

2. The method of manufacturing a spark plug according to claim 1, wherein said chromate processing bath is performed such that the temperature of said bath is set to be 20° C. to 80° C.

3. The method of manufacturing a spark plug according to claim 1, wherein said main metal shell is immersed in said chromate processing bath for 20 seconds to 80 seconds.

4. The method of manufacturing a spark plug according to claim 1, wherein sodium salt in a predetermined quantity is mixed in said chromate processing bath in such a manner that the content of the sodium components contained in the obtained chromate film is 2 wt % to 7 wt %.

5. The method of manufacturing a spark plug of claim 1, wherein said chromate film is formed on the surface of a zinc-plated layer of the main metal shell.

* * * * *